US006282838B1

(12) United States Patent
Yoshikawa

(10) Patent No.: US 6,282,838 B1
(45) **Date of Patent: *Sep. 4, 2001**

(54) DOUBLE SWING DOOR OPENING/CLOSING MECHANISM

(75) Inventor: Takashi Yoshikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,820

(22) Filed: Dec. 20, 1999

Related U.S. Application Data

(62) Division of application No. 08/853,916, filed on May 9, 1997, now Pat. No. 6,085,463.

(30) Foreign Application Priority Data

May 14, 1996 (JP) ..... 8-119323

(51) Int. Cl.[7] ..... E05D 15/50
(52) U.S. Cl. ..... 49/193; 49/192; 49/382
(58) Field of Search ..... 49/192, 193, 240, 49/245, 382

(56) References Cited

U.S. PATENT DOCUMENTS

| | | | |
|---|---|---|---|
| 3,454,299 | | 7/1969 | Hewitt et al. . |
| 3,889,419 | | 6/1975 | Maleck . |
| 4,495,673 | | 1/1985 | Khan . |
| 4,503,582 | | 3/1985 | Gurubatham . |
| 4,503,583 | | 3/1985 | Frohbieter . |
| 4,503,584 | | 3/1985 | Malchow . |
| 4,613,174 | | 9/1986 | Berg et al. . |
| 4,947,583 | | 8/1990 | Inui et al. . |
| 5,144,720 | | 9/1992 | Aihara et al. . |
| 5,417,011 | | 5/1995 | Keszthelyi . |
| 5,530,992 | | 7/1996 | Baermann . |
| 5,675,934 | | 10/1997 | Park . |
| 5,829,197 | * | 11/1998 | Oh ..... 49/193 |
| 5,983,453 | * | 11/1999 | Miwa ..... 16/231 |
| 6,000,771 | * | 11/1998 | Wissinger et al. ..... 312/405 |

FOREIGN PATENT DOCUMENTS

| | | |
|---|---|---|
| 2510856 | 9/1975 | (DE) . |
| 3111595A1 | 10/1982 | (DE) . |
| 135404 | 12/1919 | (GB) . |
| 404238982 | 8/1992 | (JP) . |
| 55431 | 2/1993 | (JP) . |
| 6129759 | 5/1994 | (JP) . |

* cited by examiner

*Primary Examiner*—Daniel P. Stodola
*Assistant Examiner*—Curtis Cohen

(57) ABSTRACT

A pair of slide cams are provided symmetrically about the center line of a door at the right-hand and left-hand end portions of the door, a pair of lock cams provided on the main body symmetrically in portions corresponding to those of the slide cams, and a hinge pin mounted so that it penetrates an axial hole provided in the lock cams. Each slide cam has a first grooved cam which can be engaged with and disengaged from the hinge pin in the horizontal direction, and a second grooved cam which can move from a first engagement position which continues from the first grooved cam and is engaged with the hinge pin guided by the first grooved cam when the door is closed to a second engagement position which serves as a pivot axis of the slide cam when the door is opened. Each slide cam is further provided with a first cam projection provided around the second grooved cam. Each lock cam is provided with a second cam projection which locks the first cam projection in the first engagement position.

12 Claims, 38 Drawing Sheets

53
54
55

59
55

59
h
g
f
53
61
55
54
d 59
55

53
54
55

62
56
57
58
60
f
g
h
i
j
d g
d
d
40
g

DOUBLE SWING DOOR OPENING/CLOSING MECHANISM

This application is a application divisional of application Ser. No. 08/853,916, filed on May 9, 1997, now U.S. Pat. No. 6,085,463 issued Jul. 11, 2000 the entire contents of which are hereby incorporated by reference.

BACKGROUND OF THE INVENTION

1. Field of the Invention

The present invention relates to door opening/closing mechanisms for refrigerators and the like, and in particular to a door opening/closing mechanism for opening and closing the door from either the right-hand side or the left-hand side.

2. Description of Related Art

According to a prior art door opening/closing device as disclosed in, for example, Japanese Utility Model Publication No. HEI 5-5431, a door is provided with a securing plate having an engagement groove which can be releasably engaged with a hinge pin on a main body from the open side of the door, a latch plate which is releasably engaged in a pivotal manner with the hinge pin by a latch groove at both the right-hand and left-hand portions of the securing plate and constrains the hinge pin in the groove, and a connecting member on the door which is interlocked with the pivoting of the latch plate in a direction in which the constraint of the latch plate is released and prevents the other latch plate from pivoting.

As another prior art, Japanese Patent Laid-Open Publication No. 6-129759 discloses an automatic door opening/closing device with brake comprised of a motor with brake mounted so that its output shaft is disposed coaxially with the hinge pin of the door, a door opening/closing arm mounted to a lower end of the output shaft, an elastic member such as a spring and a resistance detector.

The former door opening/closing device is provided with a spring for constraining the pivoting of the latch plate. Therefore, a repelling force against the spring force is required in opening and closing the door, and this has the disadvantage that opening and closing the door require more force. There has been another problem that an operating noise (mechanical noise) is generated because the mechanism is operated against the spring force. Furthermore, if the latch plate on the open side is operated to be put into a locked state when the door is open, the door will be disengaged and fall off when a force is exerted on the pivot shaft side. In addition, due to an increased number of components, a complicated assembling work, high component and assembling costs and the components arranged all along the door, the device has had the problem that the whole mechanism occupies a large space.

On the other hand, since the driving of the pivoting operation is performed on the pivot shaft side in the latter door opening/closing device, a considerably great power is required as a load torque of the motor which serves as a driving power source. Furthermore, since the device is a single swing door system, there is the disadvantage that two drive power sources are required to cope with a double swing door system. Furthermore, in the case of the double swing door system, it is required to voluntarily switch the engagement between the drive unit and the door, and there is another problem that the door cannot be opened without electrification and cannot be opened from inside the refrigerator.

SUMMARY OF THE INVENTION

The object of the present invention is therefore to provide a novel and useful double swing door opening/closing mechanism which solves the aforementioned problems.

In order to achieve the aforementioned object, a double swing door opening/closing mechanism is provided comprising. cam mechanisms which are provided on the right-hand and left-hand sides of a door respectively and cause the door to be engaged with and disengaged from a main body, the cam mechanisms being able to assume a first engagement position which is symmetrically arranged on the right-hand and left-hand sides of the door and a second engagement position which is symmetrically arranged on the right-hand and left-hand sides of door. The right-hand and left-hand cam mechanisms assume the first engagement position in a state in which the door is closed, and the door slides when the door is opened at either the right-hand side or the left-hand side of the door, so that the cam mechanism at the other side assumes the second engagement position and is pivotally locked in the second engagement position.

With this arrangement, both the right-hand and left-hand cam mechanisms are in the first engagement position when the door is closed, therefore the door fitting state is maintained by the engagement force. Then, the engagement state remains without locking at both the right-hand and left-hand cam mechanism, and therefore, the engagement can be easily released when the door is pulled at either the right-hand side or the left-hand side in this state. Furthermore, when the engagement is released at one side, the other side is locked in the second engagement position while being able to pivot. Therefore, the door can be opened as if it were a usual single swing door.

Also, a double swing door opening/closing mechanism is provided comprising:

a pair of slide cam members which are respectively provided symmetrically about a center line of a door as arranged at right-hand and left-hand end portions of the door or a main body on which the door is mounted;

a pair of lock cam members provided symmetrically in portions corresponding to those of the slide cam members on the main body or the door; and a hinge pin which is mounted in a state in which it penetrates an axial hole provided at each of the lock cam members; and wherein the each slide cam member has a first grooved cam which can be engaged with and disengaged from the hinge pin in a horizontal direction, and a second grooved cam which can move from a first engagement position which continues from the first grooved cam and is engaged with the hinge pin guided by the first grooved cam when the door is closed to a second engagement position which serves as a pivot axis of the slide cam member when the door is open, and a first cam projection provided around the second grooved cam, and the each lock cam member has a second cam projection which locks the first cam projection in the first engagement position. According to this arrangement, the hinge pin serves as a pivot axis when the door is opened and closed.

Also, a double swing door opening/closing mechanism is provided comprising:

cam mechanisms which are respectively provided on the right-hand and left-hand sides of a door and cause the door to be engaged with and disengaged from a main body, the cam mechanisms being able to assume a first engagement position which is symmetrically arranged on the right-hand and left-hand sides of the door and a second engagement position which is symmetrically arranged on the right-hand and left-hand sides of the door, and wherein the right-hand and left-hand cam mechanisms assume the first engagement position in a state in which the door is closed, and the door slides when the door is opened at one side of the right-hand side and the left-hand side of the door, so that the cam mechanism at the other side assumes the second engagement position and is pivotally locked in the second engagement position; and an assisting means for urging the door toward the second engagement position so as to assist the locked state in the second engagement position.

According to this arrangement, the assisting means assists the movement of the door towards the locked state in the second engagement position, and therefore, an improved reliability of the door opening/closing mechanism is achieved.

Also, a double swing door opening/closing mechanism is provided comprising a powered mechanism for performing a door opening assisting operation by releasing the cam engagement by a power from the closed state of the door achieved by the cam engagement. According to this arrangement, the engagement state of the door can be released merely by operating the operating members such as switches. Therefore, the door opening operation is made easy, which is convenient.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will be described below with reference to the accompanying drawings. FIGS. 1A through 1E through 5A through 5D show a first embodiment, and the main components of the door opening/closing mechanism are shown in FIGS. 1A through 1E and 2A through 2E. FIGS. 1A through 1E are detailed views of a slide cam 1 to be mounted on the door side (not shown), while FIGS. 2A through 2E are detailed views of a lock cam 2 to be mounted on the main body side (not shown). In these figures, A shows a rear view, B shows a plan view, C shows a front view, D shows a sectional view of a line d—d, and E shows a sectional view of a line e—e in FIG. 1B.

Figure 1A:
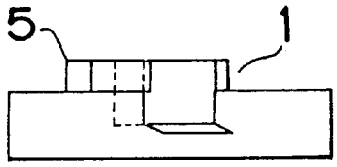
FIGS. 1A through 1E are views showing a slide cam of a first embodiment of the present invention.
Figure 1B:
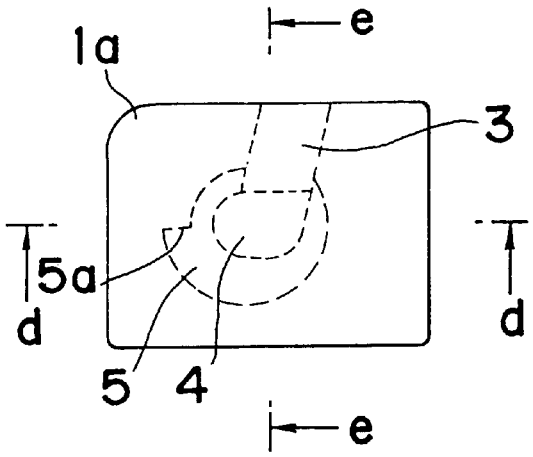
Figure 1E:
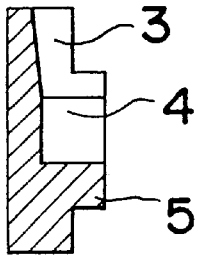
Figure 1C:
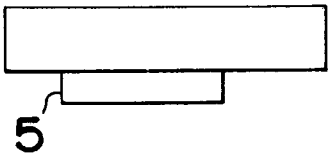
Figure 1D:
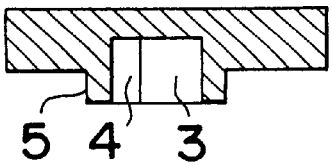
Figure 2A:
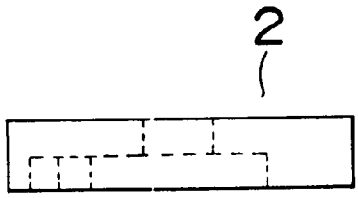
FIGS. 2A through 2E are views showing a lock cam of the first embodiment of the present invention.
Figure 2B:
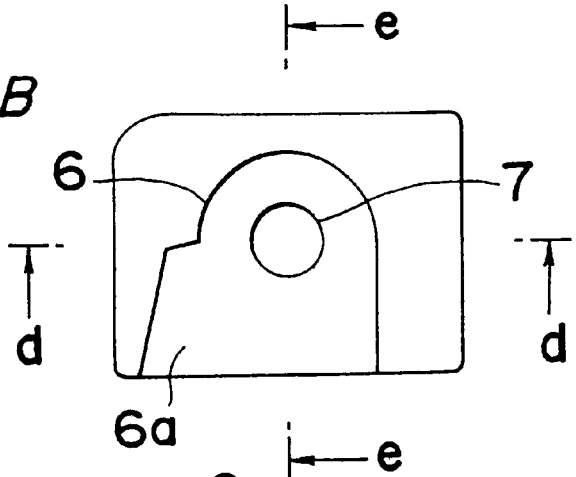
Figure 2E:
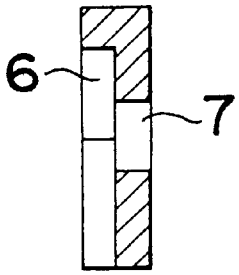
Figure 2C:
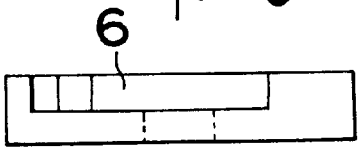
Figure 2D:
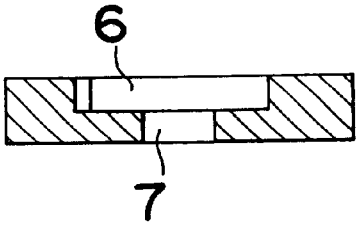
Figure 3A:
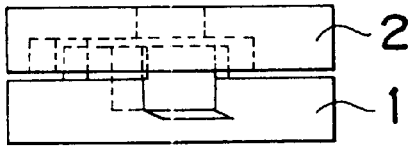
FIGS. 3A through 3D are views showing a state in which the slide cam and the lock cam are combined with each other.
Figure 3B:
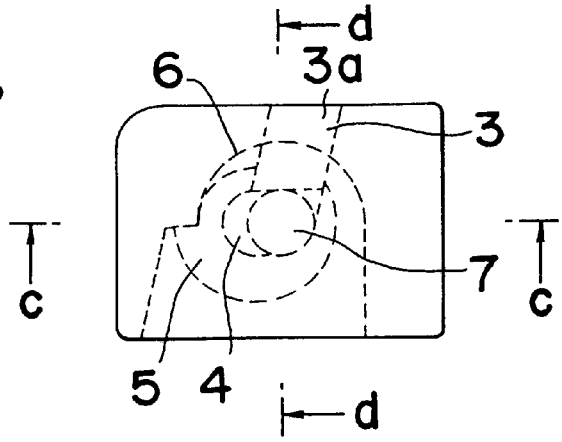
Figure 3D:
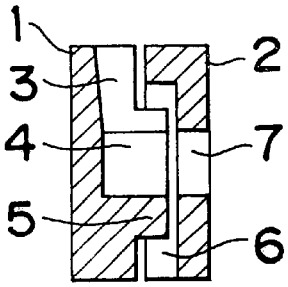
Figure 3C:
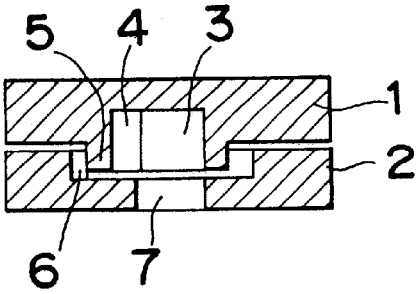

The slide cam 1 has a first grooved cam 3, a second grooved cam 4 continued from the first grooved cam 3 and a first cam projection 5 provided around the second grooved cam 4. The first grooved cam 3 extends from one end to a center portion of a member 1*a* of the slide cam 1 and continues to the second grooved cam 4 formed in a center portion of the member 1*a*. This first grooved cam 3 is deep at the one end of the member 1*a* as shown in FIG. 1E and is gradually shallowed toward the center portion. The outer peripheral surface of the first cam projection 5 changes in a snail-like shape, and its end portion 5*a* has an increased diameter to serve as an abutment portion (stepped portion) for achieving a cam engagement state when the door is closed as described later.

FIGS. 2A through 2E show the surfaces of the lock cam 2 corresponding to FIGS. 1A through 1E. The lock cam 2 has a second cam projection 6 to be engaged with the first cam projection 5 of the slide cam 1. The reference numeral 6*a* denotes a groove forming the second cam projection 6, and a through hole 7 is provided in the groove 6*a*. A hinge pin 14 provided on the main body side as described later penetrates this hole 7, and its center axis coincides with a pivot axis 8.

The first grooved cam 3 provided at the slide cam 1 is guided by the hinge pin 14, while the second grooved cam 4 operates to guide the slide cam 1 into a position where it is not disengaged from the hinge pin 14. Similarly, the first cam projection 5 provided at the slide cam 1 is slidably guided by the second cam projection 6 provided at the lock cam 2 according as the door is opened, thereby operating so that the slide cam 1 is not disengaged from the pivot axis 8 and consequently preventing the door from falling off the main body.

FIGS. 3A through 3D are views showing a state in which the slide cam 1 and the lock cam 2 are combined with each other. In FIGS. 3A through 3D, the components are mutually related in position in the case where the door is completely closed.

FIGS. 4A through 4D show the engagement and disengagement operations of both of a pair of slide cams 1 mounted on the right-hand and left-hand sides of the door and a pair of lock cams 2 mounted in position corresponding to them on the main body side (e.g., refrigerator). In more detail, FIGS. 4A through 4D are plan views of a state in which different-hand component combinations of the slide cam 1 (solid line) and the lock cam 2 (dashed line) are laterally symmetrical, thereby forming a door hinge capable of being opened at the right-hand and left-hand sides, and show an operation in the case where the door is opened from the right-hand side.

Figures 4A, 4B, 4C, 4D:
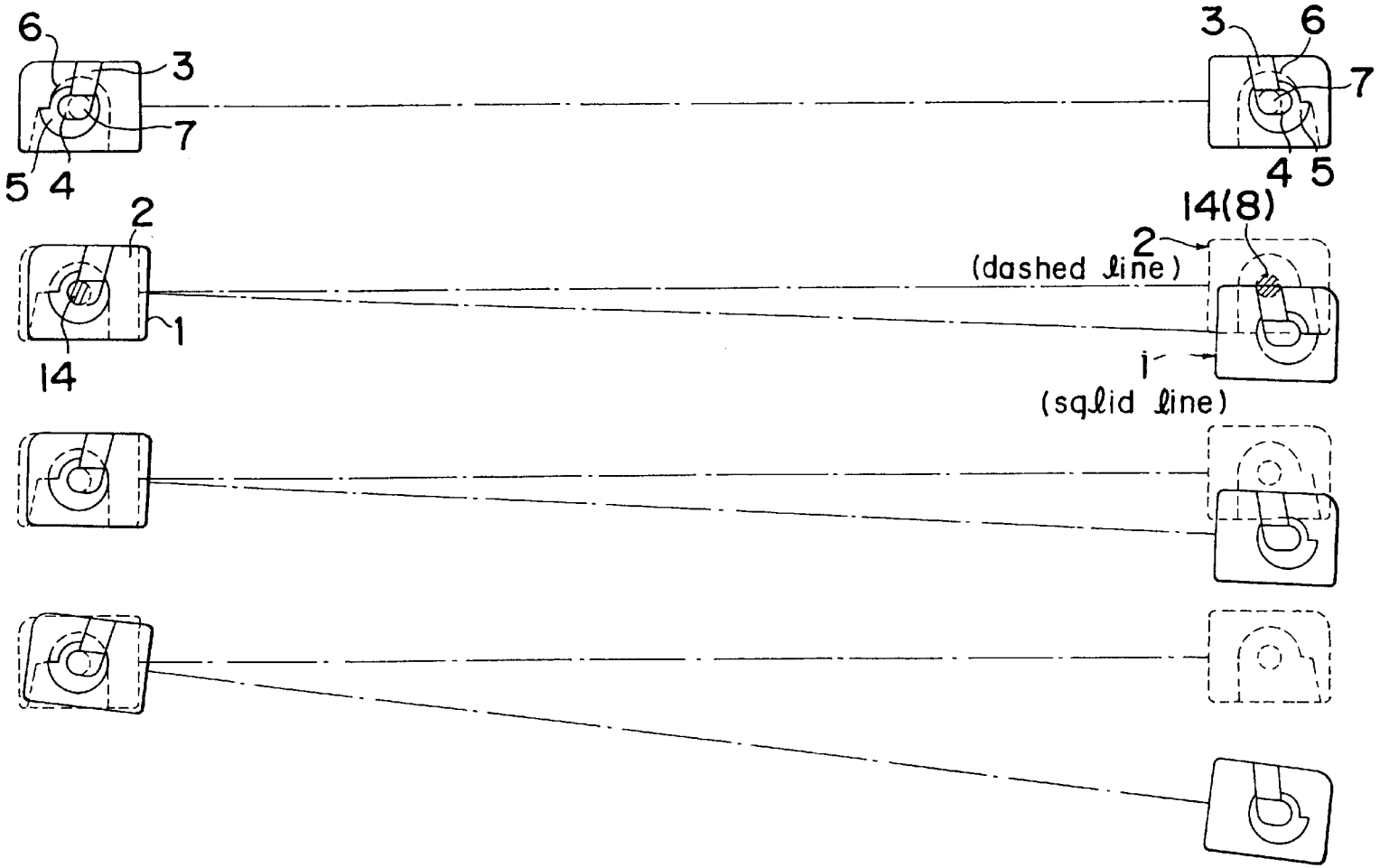
FIGS. 4A through 4D are views showing the movements of the slide cam and the lock cam in opening a door at the right-hand side.
Figures 5A, 5B, 5C, 5D:
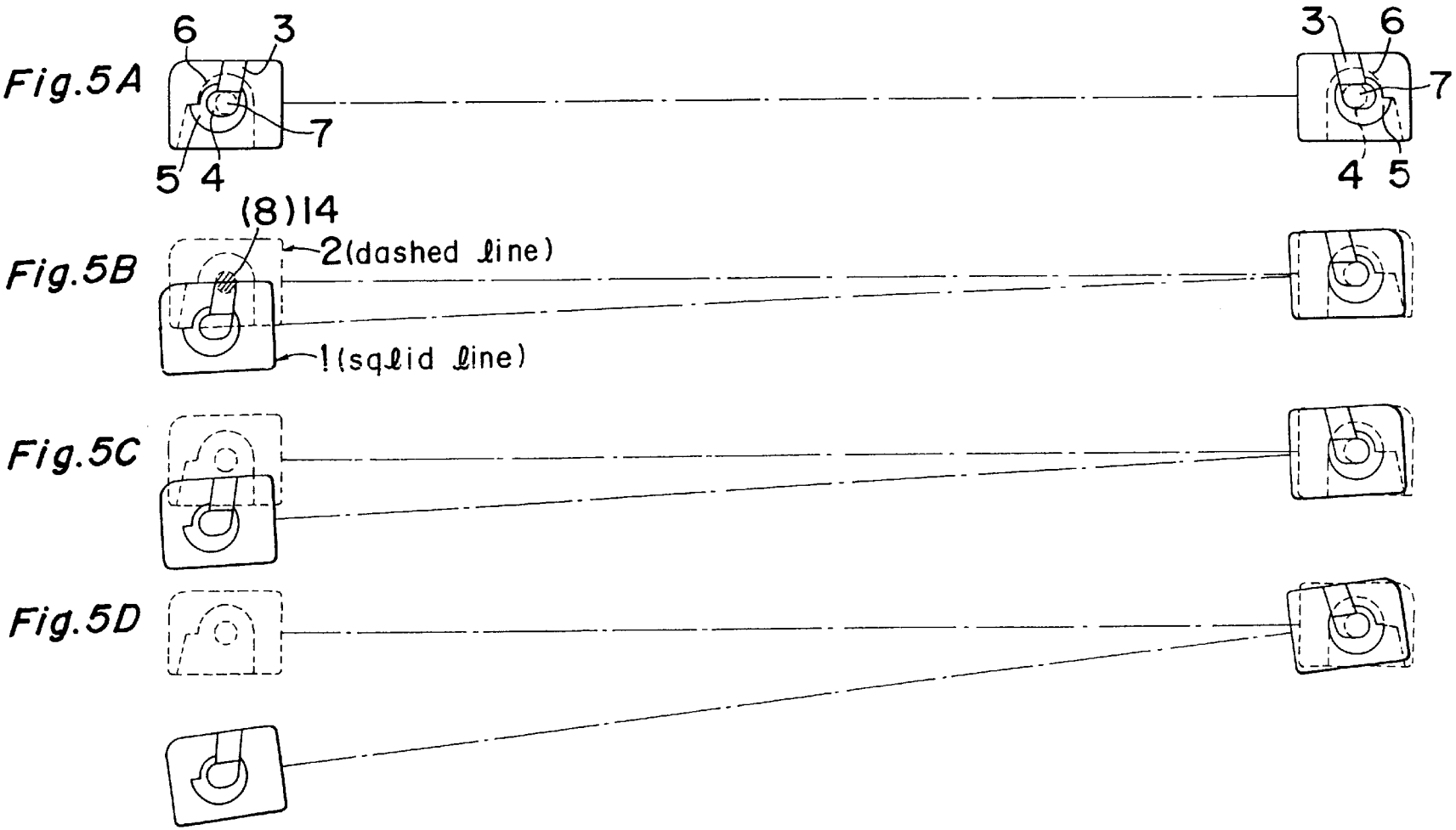
FIGS. 5A through 5D are views showing the movements of the slide cam and the lock cam in opening the door at the left-hand side.
Figure 6A:
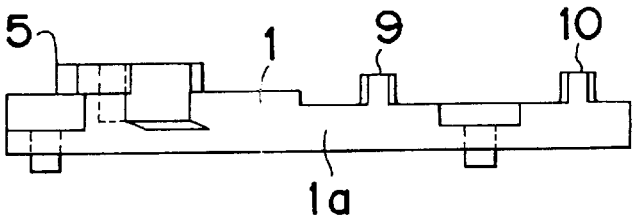
FIGS. 6A through 6E are views showing a slide cam of a second embodiment of the present invention.
Figure 6B:
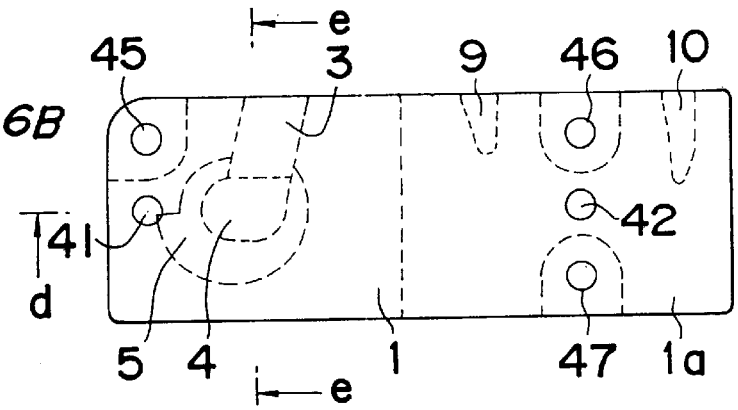
Figure 6E:
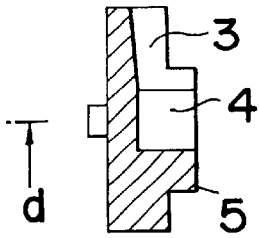
Figure 6C:
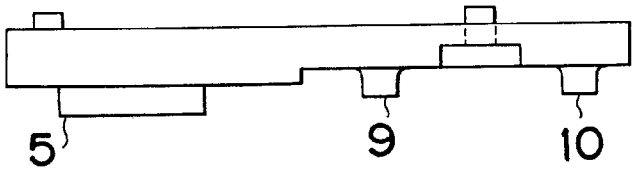
Figure 6D:
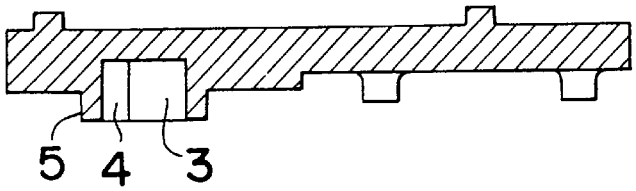
Figure 7A:
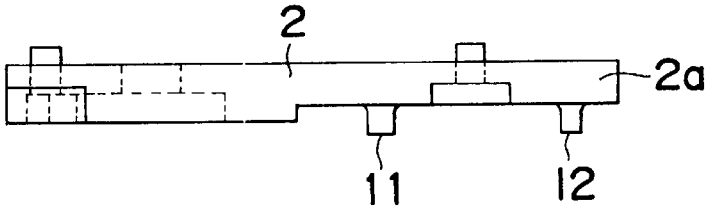
FIGS. 7A through 7E are views showing a lock cam of the second embodiment of the present invention.
Figure 7B:
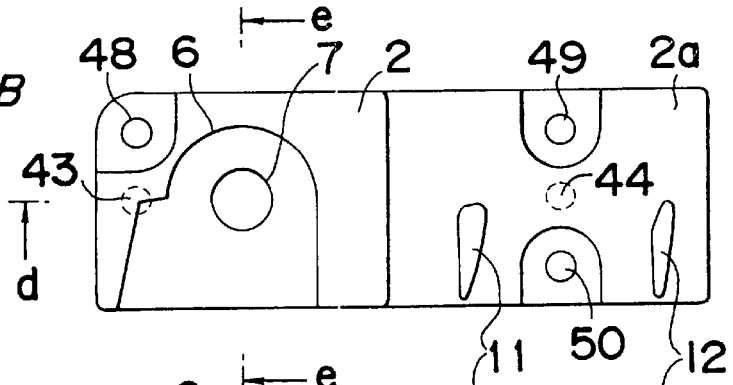
Figure 7E:
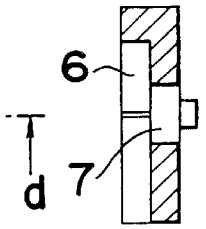
Figure 7C:
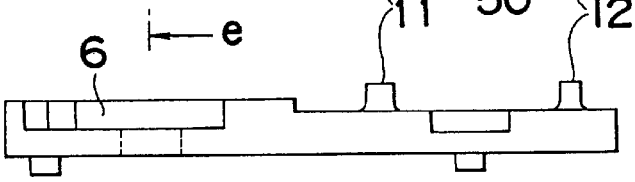
Figure 7D:
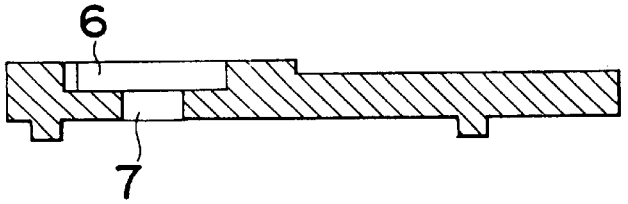
Figure 8A:
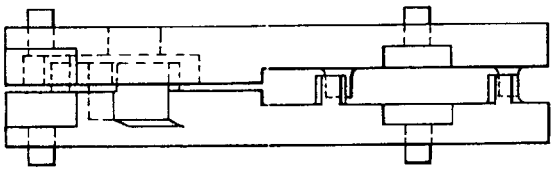
FIGS. 8A through 8D are views showing a state in which the slide cam and the lock cam are combined with each other.
Figure 8B:
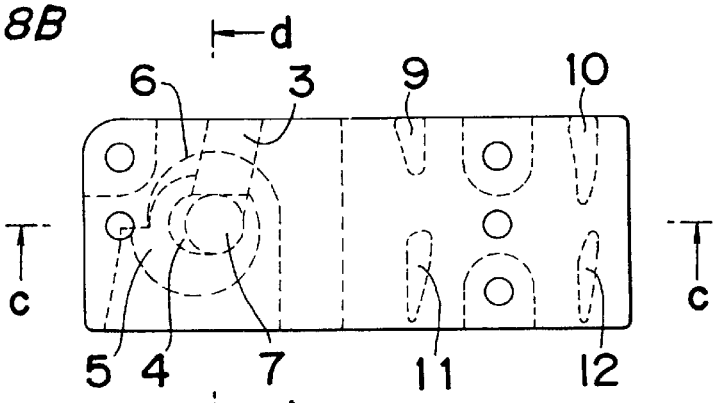
Figure 8D:
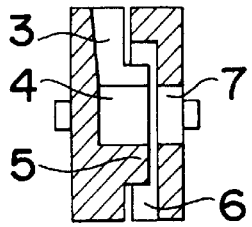
Figure 8C:
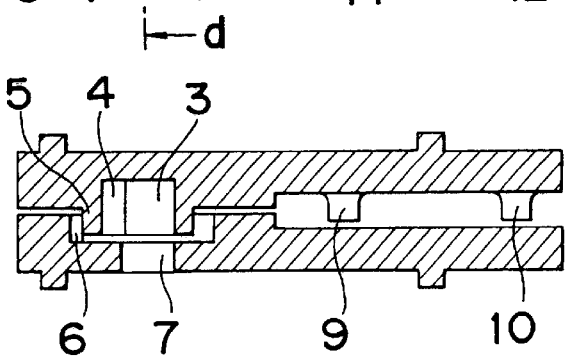

FIG. 4A shows a state in which the door is completely closed, where the slide cams 1 mounted on the door side and the lock cams 2 mounted on the main body side are completely combined with each other so as to be laterally symmetrical in the respective first engagement positions. In this stage, the first grooved cams 3 provided at the right-hand and left-hand slide cams 1 are formed so that they are directed obliquely inwardly with respect to the door and restricted by the respective hinge pins 14. Therefore, the door does not fall off the main body even when the user pulls on the door from both the right-hand and left-hand sides thereof.

FIG. 4B shows a state in which the door starts to open from the right-hand side, where the first grooved cam 3 provided at the right-hand slide cam 1 is disengaged from the hinge pin 14 that is penetrating the hole 7 provided at the right-hand lock cam 2. In this stage, the first grooved cam 3 guided by the hinge pin 14 slides the door slightly rightward. Consequently, the second grooved cam 4 provided at the left-hand slide cam 1 and the hinge pin 14 that is penetrating the hole 7 provided at the left-hand lock cam 2 are engaged in position so that the slide cam 1 is not disengaged from the left-hand hinge pin 14.

Further, as the door pivots as shown in FIGS. 4C and 4D, the first cam projection 5 provided at the left-hand slide cam 1 is slidably guided by the second cam projection 6 provided at the left-hand lock cam 2 to operate so that the slide cam 1 is not disengaged from the left-hand pivot axis 8, thereby preventing the door from falling off the main body and allowing the opening and closing of the door to be surely performed. In FIGS. 4B, 4C and 4D, the left-hand cam mechanism is put in the second engagement position where it is pivotally locked.

FIGS. 5A through 5D are views showing an operation when the door is opened from the left-hand side, and this is an operation laterally symmetrical to the case of FIGS. 4A through 4D.

Next, in a second embodiment shown in FIGS. 6A through 6E through FIGS. 10A through 10D, the slide cam member 1*a* and the lock cam member 2*a* are each formed in an laterally elongated form in addition to the construction of the aforementioned first embodiment, and first through fourth outer cams 9, 10, 11 and 12 are provided. In other words, the second embodiment differs from the first embodiment in the point that the function of the outer cams 9 through 12 are incorporated into the first embodiment.

FIGS. 6A through 6E and 7A through 7E show the main components of the second embodiment. FIGS. 6A through 6E are detailed views of a slide cam member 1*a* to be mounted on the door side (not shown), while FIGS. 7A through 7E are detailed views of a lock cam member 2*a* to be mounted on the main body side (not shown) of the apparatus. In these figures, a hinge pin 14 provided on the main body side as described later penetrates a hole 7 provided at the lock cam 2, and its center axis coincides with a pivot axis 8.

The first grooved cam 3 provided at the slide cam 1 guides the pivot axis 8, while the second grooved cam 4 operates to guide the slide cam 1 into a position where it is not disengaged from the pivot axis 8. Similarly, the first cam projection 5 provided at the slide cam 1 is slidably guided by the second cam projection 6 provided at the lock cam 2 according as the door is opened to operate so that the slide cam 1 is not disengaged from the pivot axis 8, thereby preventing the door from falling off the main body.

The slide cam member 1*a* is further provided with a first outer cam (slide cam) 9 and a second outer cam (slide cam) 10 both side surfaces of which are formed into an arc shape, and the lock cam member 2*a* is provided with a third outer cam 11 and a fourth outer cam 12 both side surfaces of which are formed into an arc shape. They are guided as engaged with each other when the door is opened, so that the slide cam 1 is more surely guided into a position where it is not disengaged from the pivot axis 8. This will be described in detail later. It is to be noted that the reference numerals 41 through 44 denote positioning pins, and the reference numerals 45 through 50 are holes through which screws for mounting use penetrate.

FIGS. 8A through 8D are views showing a state in which the slide cam 1 and the lock cam 2 are combined with each other. In FIGS. 8A through 8D, the components are mutually related in position in the case where the door is completely closed.

FIGS. 9A through 9D are plan views of a state in which different-hand component combinations of the slide cam member 1*a* and the lock cam member 2*a* are arranged in laterally symmetrical positions, thereby forming a door hinge capable of being opened at the right-hand and left-hand sides, and show an operation in the case where the door is opened from the right-hand side.

Figures 9A, 9B, 9C, 9D:
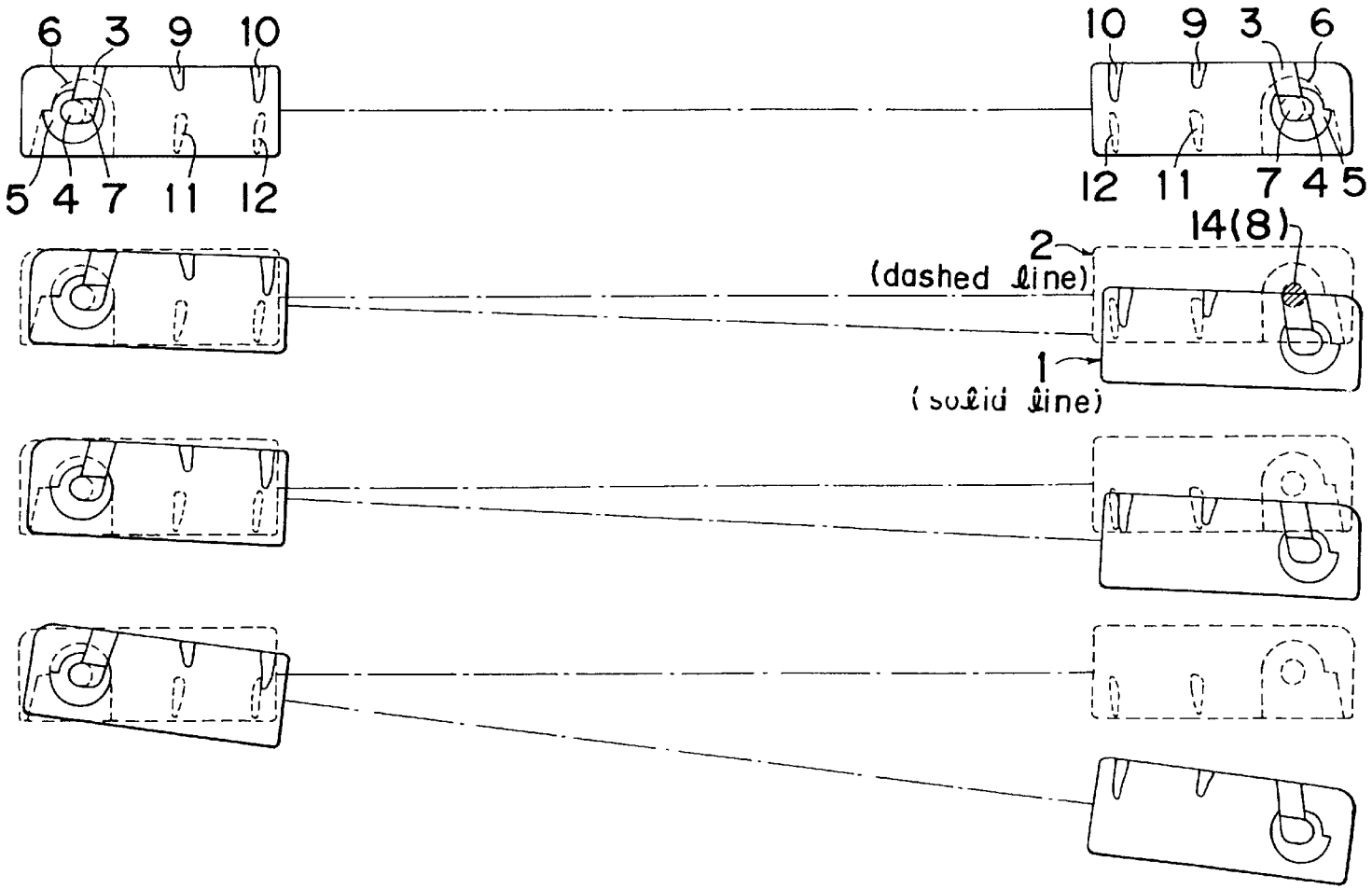
FIGS. 9A through 9D are views showing the movements of the slide cam and the lock cam in opening a door at the right-hand side.
Figures 10A, 10B, 10C, 10D:
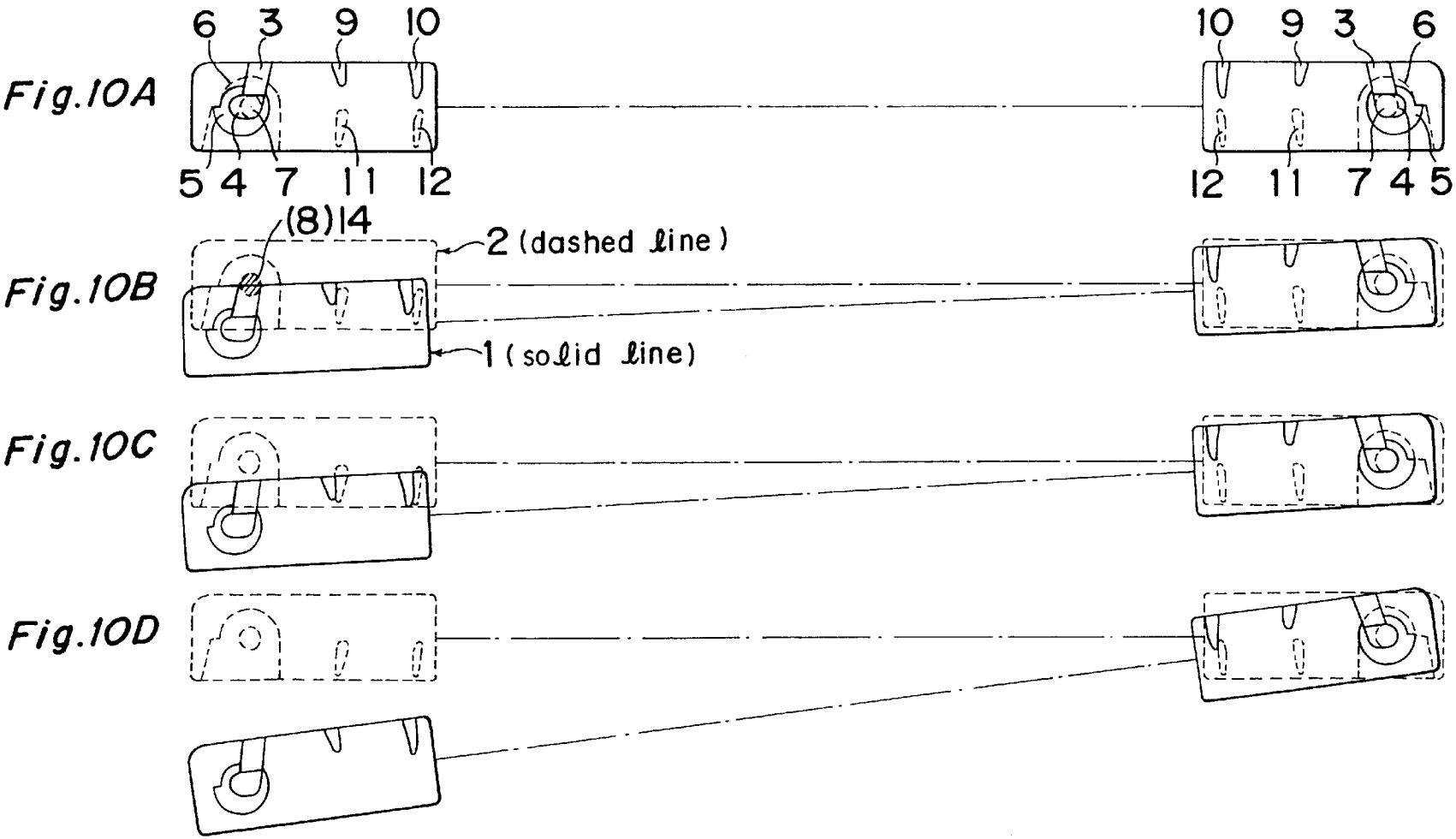
FIGS. 10A through 10D are views showing the movements of the slide cam and the lock cam in opening the door at the left-hand side.

FIG. 9A shows a state in which the door is completely closed, where the slide cam 1 mounted on the door side and the lock cam 2 mounted on the main body side are completely combined with each other laterally symmetrically. In this stage, the first grooved cams 3 provided at the right-hand and left-hand slide cams 1 are formed so that they are directed obliquely inwardly with respect to the door and restricted by the respective hinge pins 14. Therefore, the door does not fall off the main body even when the user pulls on the door from both the right-hand and left-hand sides.

FIG. 9B shows a state in which the door starts to open from the right-hand side, where the first grooved cam 3 provided at the right-hand slide cam 1 is disengaged from the hinge pin 14 that is penetrating the hole 7 provided at the right-hand lock cam 2.

In this stage, the first grooved cam 3 guided by the hinge pin 14 slides the door slightly rightward. Consequently, the second grooved cam 4 provided at the left-hand slide cam 1 and the hinge pin 14 that is penetrating the hole 7 provided at the left-hand lock cam 2 are mutually related in position so that the slide cam 1 is not disengaged from the left-hand pivot axis 8.

Further, in this stage, the first and second outer cams 9 and 10 provided at the right-hand slide cam member 1*a* and the third and forth outer cams 11 and 12 provided at the right-hand lock cam member 2*a* are slidably guided as engaged with each other. Therefore, the left-hand slide cam 1 is surely guided into a position where it is not disengaged from the pivot axis 8.

Further, according as the door pivots as shown in FIGS. 9C and 9D, the first cam projection 5 provided at the left-hand slide cam 1 is slidably guided by the second cam projection 6 provided at the left-hand lock cam 2 to operate so that the slide cam 1 is not disengaged from the left-hand pivot axis 8, thereby preventing the door from falling off the main body and allowing the opening and closing of the door to be surely performed.

In FIG. 9C, the first and second outer cams 9 and 10 provided at the right-hand slide cam member 1*a* are completely engaged with the third and fourth outer cams 11 and 12 provided at the right-hand lock cam member 2*a* respectively, and the second outer cam 10 provided at the left-hand slide cam member 1*a* starts to be engaged with the fourth outer cam 12 provided at the left-hand lock cam member 2*a*.

Further, in FIG. 9D, the first and second outer cams 9 and 10 provided at the right-hand slide cam member 1*a* are disengaged from the third and forth outer cams 11 and 12 provided at the right-hand lock cam member 2*a*, while the second outer cam 10 provided at the left-hand slide cam member 1*a* is engaged with the fourth outer cam 12 provided at the left-hand lock cam member 2*a*.

When the pivoting progresses, the second outer cam 10 provided at the left-hand slide cam member 1*a* is disengaged from the fourth outer cam 12 provided at the left-hand lock cam member 2*a*, while the first outer cam 9 provided at the left-hand slide cam member 1*a* and the third outer cam 11 provided at the left-hand lock cam member 2*a* starts to be engaged with each other (not shown).

By the operation as described above, the sliding first and second outer cams 9 and 10 come in sliding contact with the third and forth outer cams 11 and 12, so that the entire door is urged in the sliding direction. Consequently, the pivotally locked state of the cam mechanism on the pivoting shaft side of the door is surely retained. This arrangement prevents the door from falling off the main body, thereby allowing the opening and closing of the door to be surely performed.

FIGS. 10A through 10D are views of an operation when the door is opened from the left-hand side. Since the same operation as that of FIGS. 9A through 9D is performed except for symmetric property of the movement, no description is provided therefor.

Figure 11B:
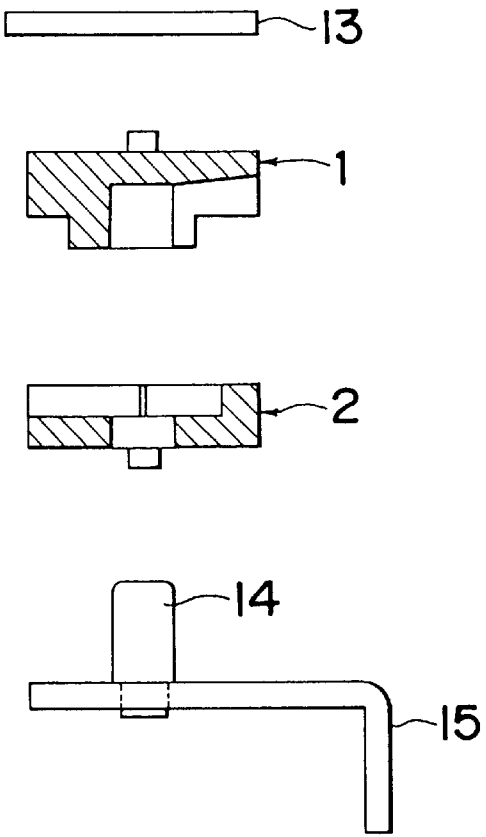
FIGS. 11A and 11B are views showing a structure in which the slide cam and the lock cam are mounted.
Figure 11A:
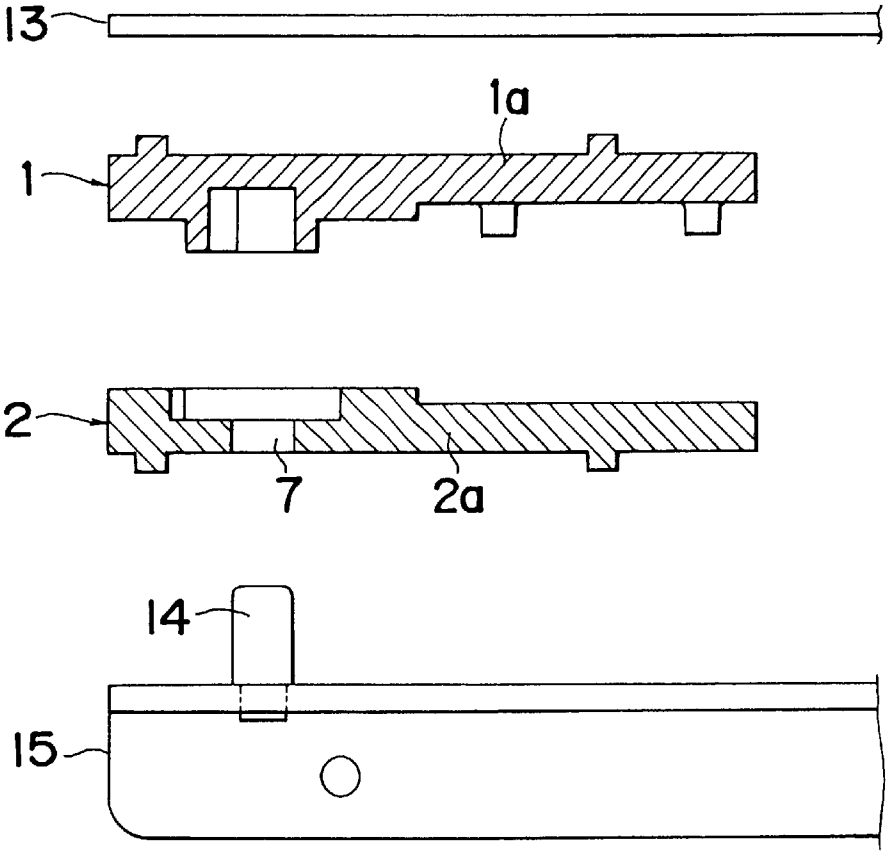

The slide cam member 1*a* of the second embodiment is mounted to a door angle 13 as shown in FIGS. 11A and 11B. The lock cam member 2*a* is mounted to a hinge angle 15. In this case, the hinge pin 14 preparatorily mounted to the hinge angle 15 protrudes above the lock cam member 2*a* through the hole 7. The door angle 13 is provided at a door (not shown). The hinge angle 15 is provided at a main body (e.g., refrigerator). It is to be noted that FIGS. 11A and 11B are a front view and a side view, respectively.

For a material of a slide cam 1 and a lock cam 2, there can be enumerated polyamide resin, a polyacetal resin or the like as a resin material to be formed by injection molding.

Figure 12C:
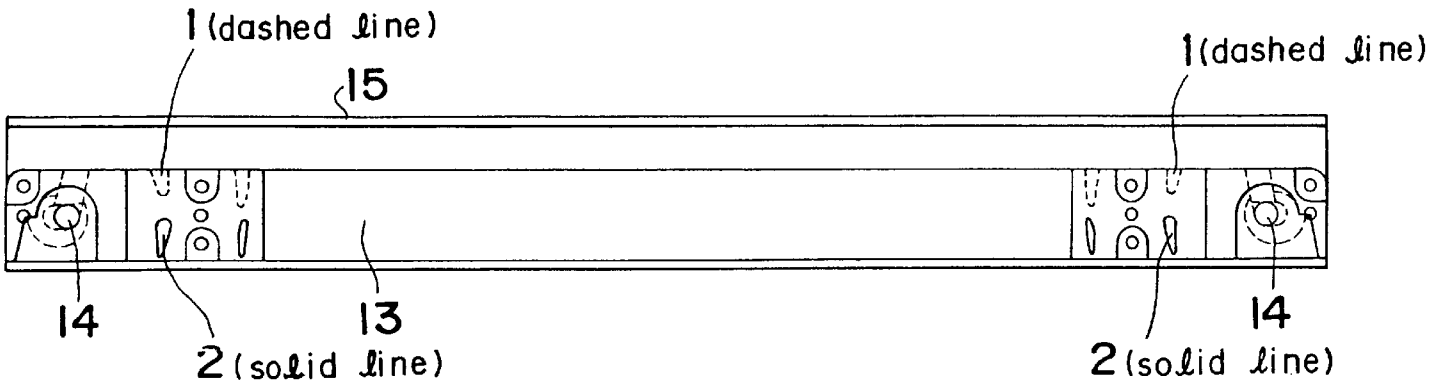
FIGS. 12A through 12C are views showing a state in which the slide cam and the lock cam are mounted to a door and a main body, respectively.
Figure 12B:
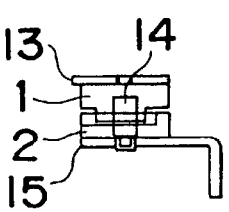
Figure 12A:
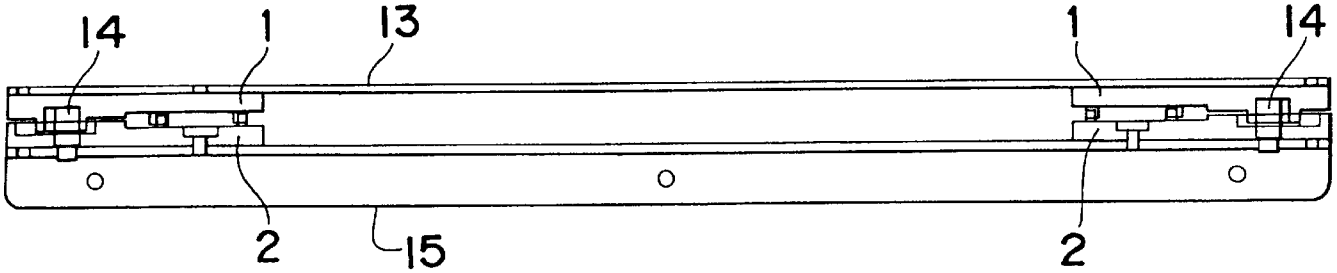
Figure 13B:
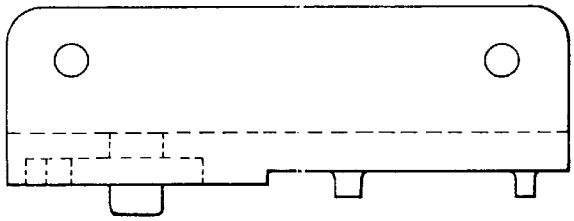
FIGS. 13A through 13E are views showing another form of the lock cam.
Figure 13A:
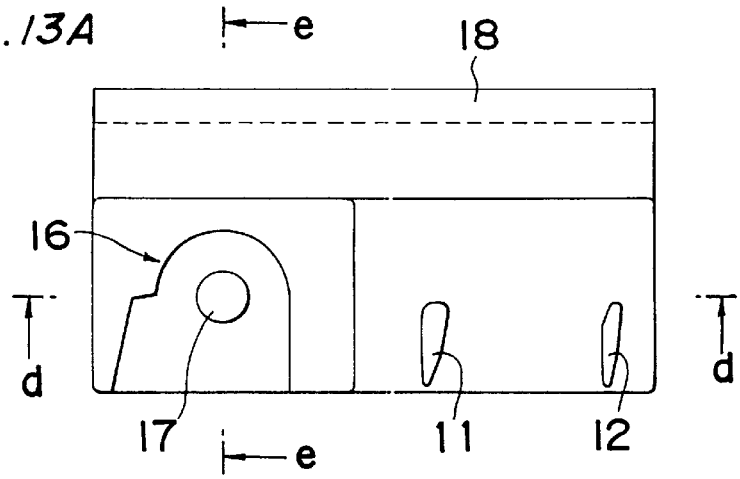
Figure 13E:
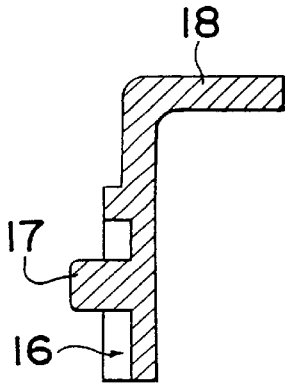
Figure 13C:
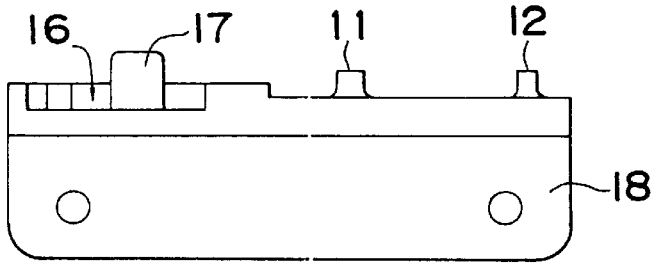
Figure 13D:
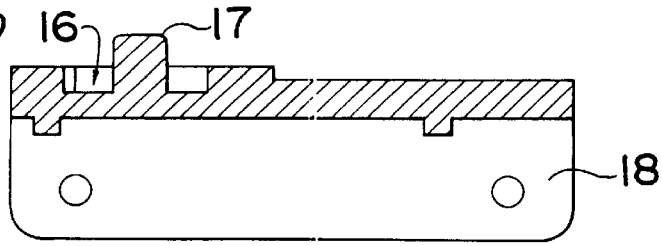

FIGS. 12A through 12C are views showing a state in which the slide cam member 1*a* and the lock cam member 2*a* are mounted in specified places as combined with each other, where FIG. 12A is a front view, FIG. 12B is a side view and FIG. 12C is a plan view. The figures show a state in which different-hand component combinations of the slide cam 1 and the lock cam 2 are arranged in laterally symmetrical positions, thereby forming a door hinge capable of being opened at the right-hand side and the left-hand side. In this case, the load of the door is received by the upper surface of the hinge pin 14.

FIGS. 13A through 13E show a case in which the lock cam 2 is integrated with the hinge pin 14 and the hinge angle 15 to be formed into a lock cam 16. Therefore, in comparison with the configuration shown in FIGS. 11A and 11B, one component is removed therefrom. In the figures, the lock cam 16 has a pin hinge 17 which serves as a pivot center of the door and a mounting section 18 to be mounted to the main body. For a material of the lock cam 16, there can be enumerated zinc alloy or the like as a die cast material.

Figure 14B:
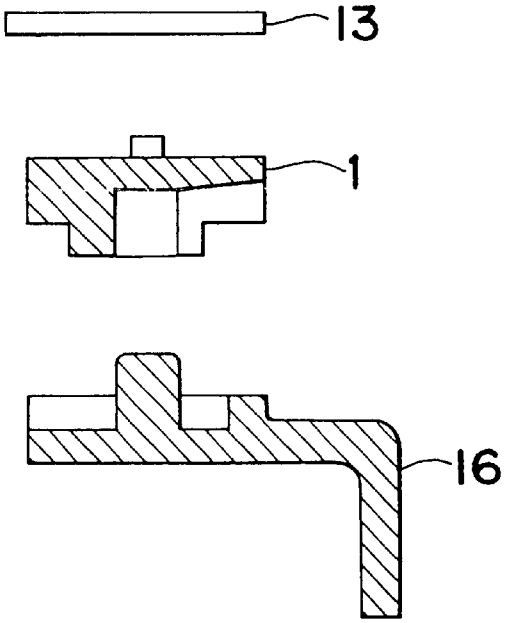
FIGS. 14A and 14B are views showing the lock cam and a slide cam.
Figure 14A:
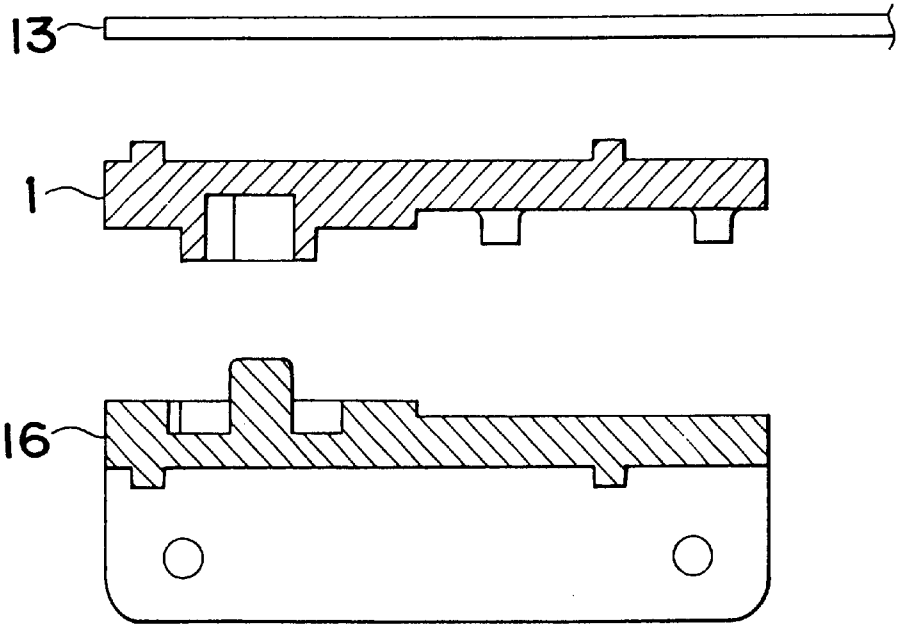

FIGS. 14A and 14B are views showing a state in which the slide cam 1 and the lock cam 16 are mounted, where FIG. 14A is a front view and FIG. 14B is a side view. In the figures, the slide cam 1 is mounted to the door angle 13 provided at a door (not shown), and the lock cam 16 is directly mounted to a main body (not shown).

Figures 15A, 15B, 15C:
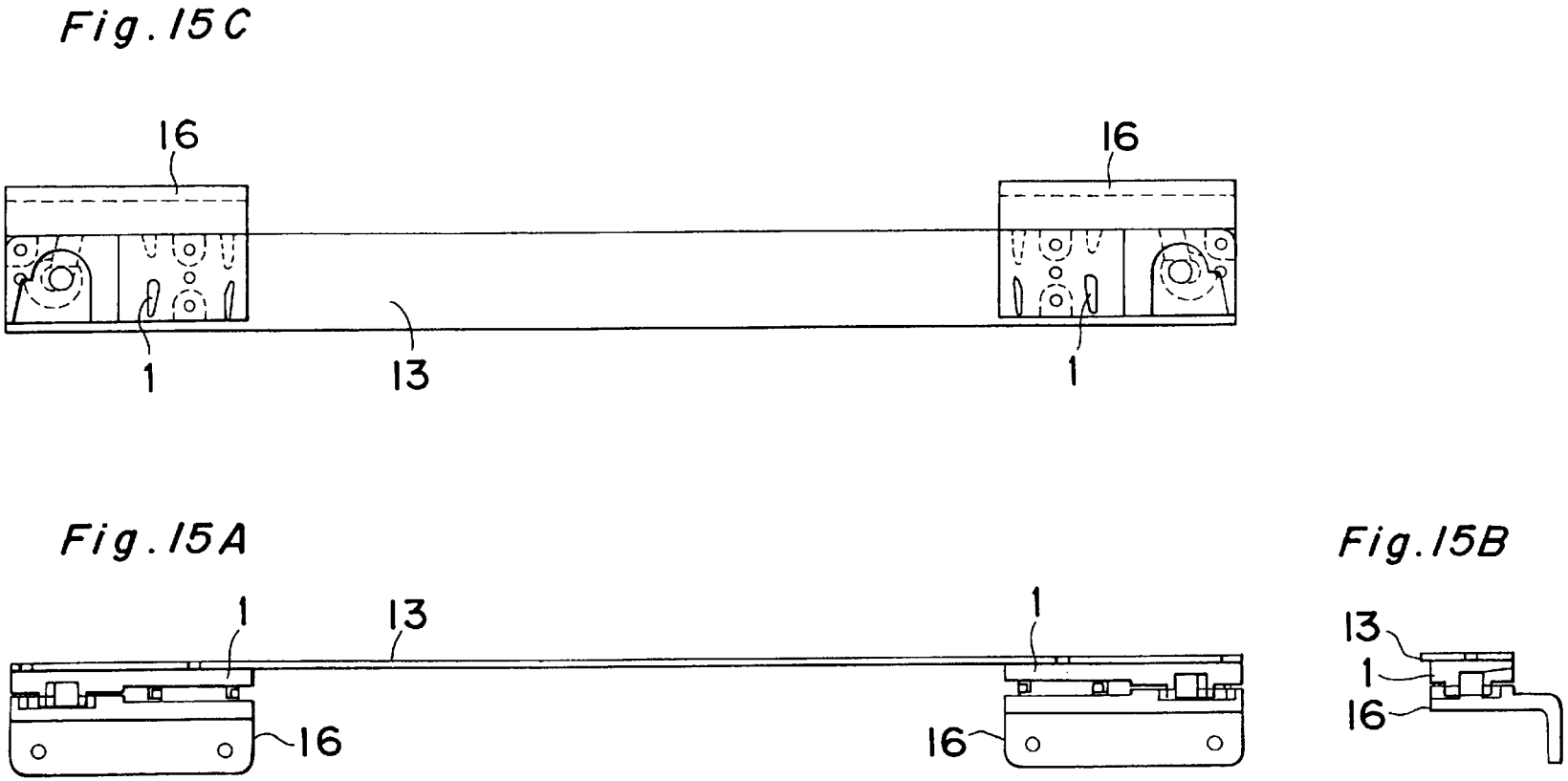
FIGS. 15A through 15C are views showing a state in which the lock cam and the slide cam are mounted to the main body and the door.

FIG. 15A through 15C are views showing a state in which the slide cam 1 and the lock cam 16 are mounted in specified places as combined with each other, where FIG. 15A is a front view, FIG. 15B is a side view and FIG. 15C is a plan view. The figures show a state in which different-hand component combinations of the slide cam 1 and the lock cam 16 are arranged in laterally symmetrical positions, thereby forming a door hinge capable of being opened at the right-hand side and the left-hand side. In this case, the load of the door is received by the upper surface of the hinge pin 17.

Figure 16A:
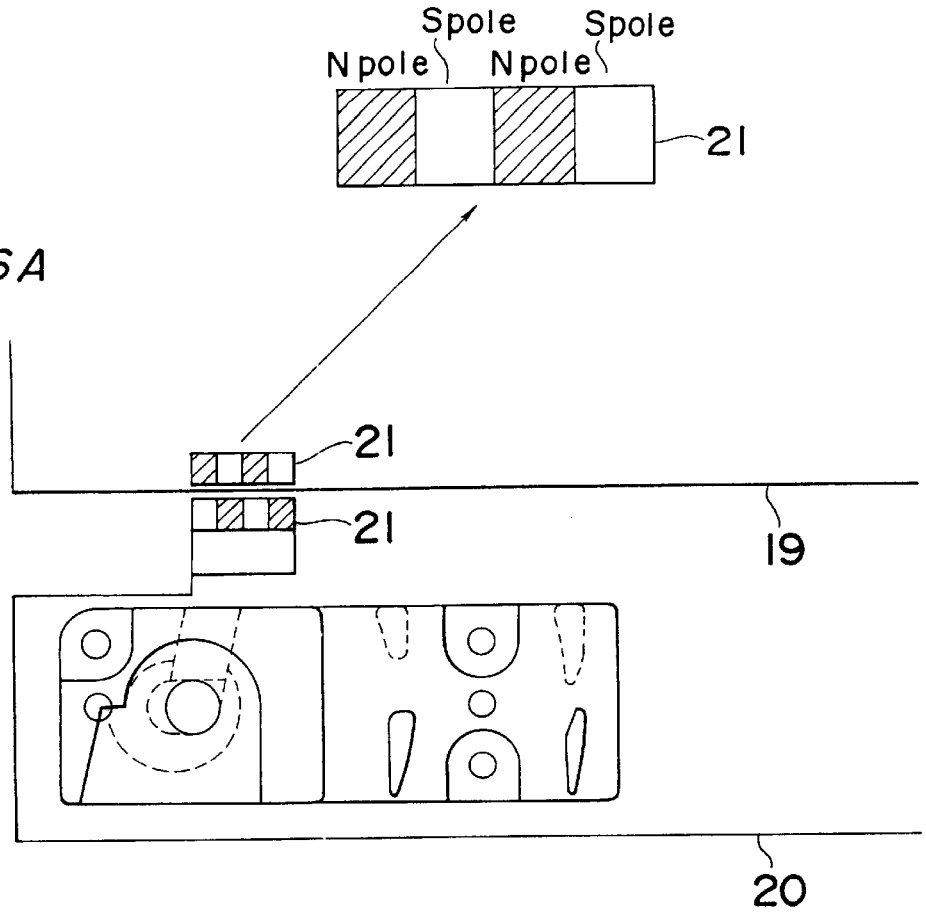
FIGS. 16A and 16B are views showing an embodiment in which the door and the main body are each provided with a magnet.
Figure 16B:
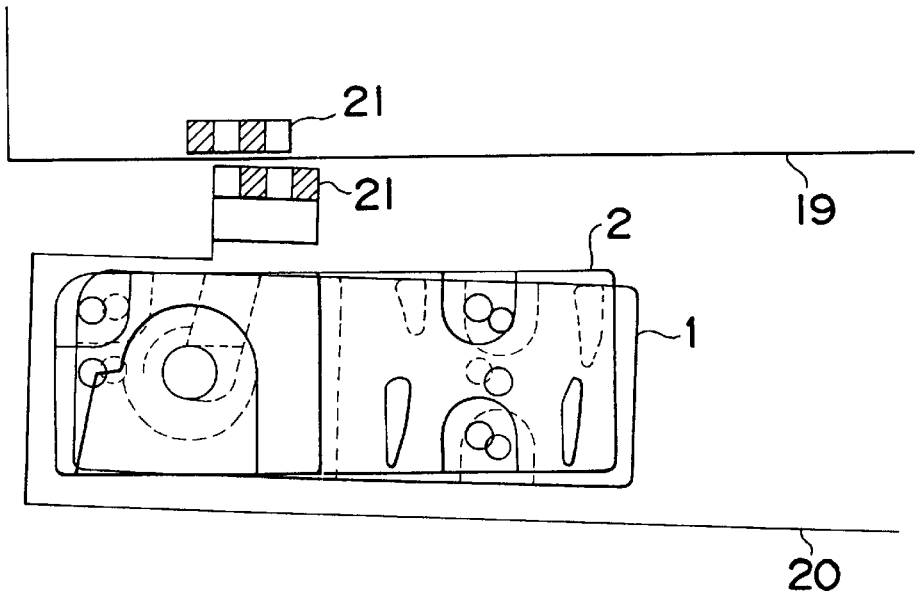
Figure 17:
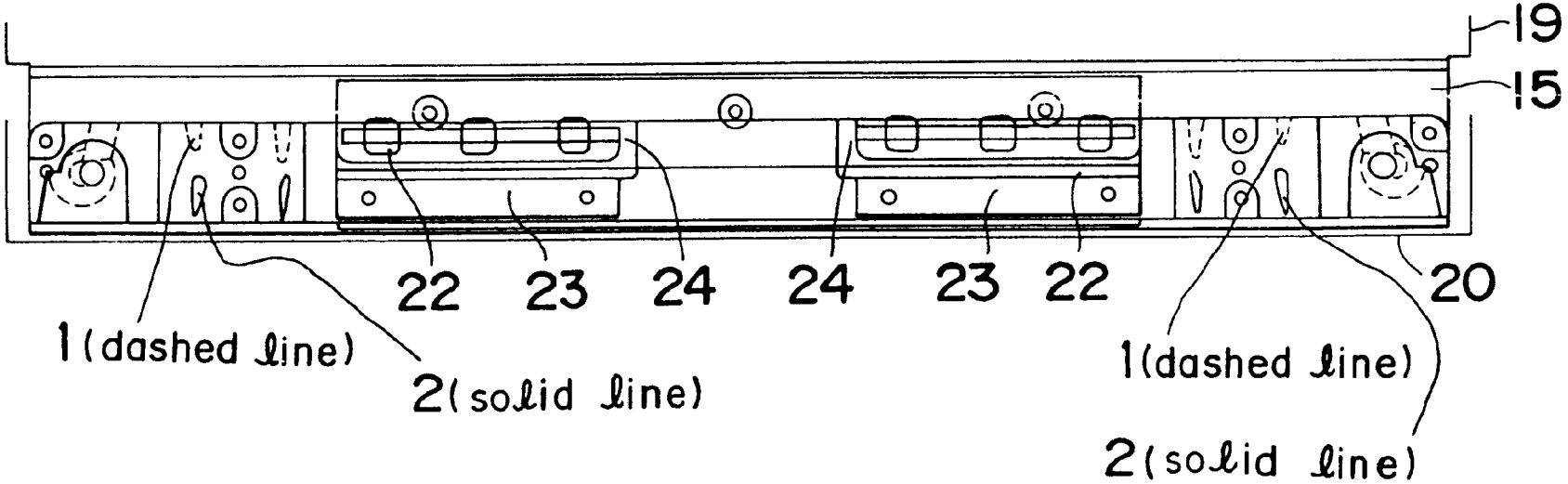
FIG. 17 is a plan view of a door manual opening/closing device.
Figure 18:
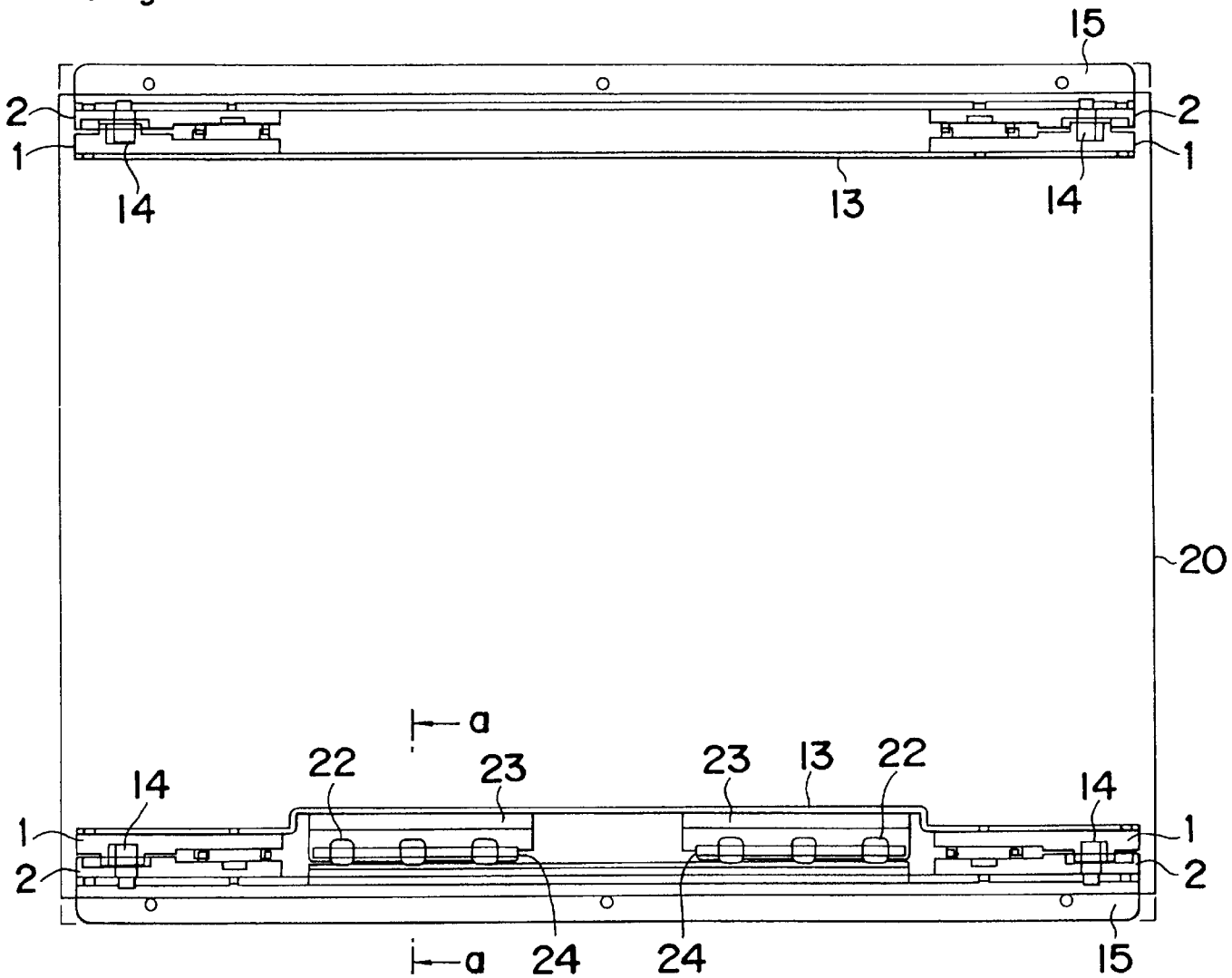
FIG. 18 is a front view of the door manual opening /closing device.
Figure 19:
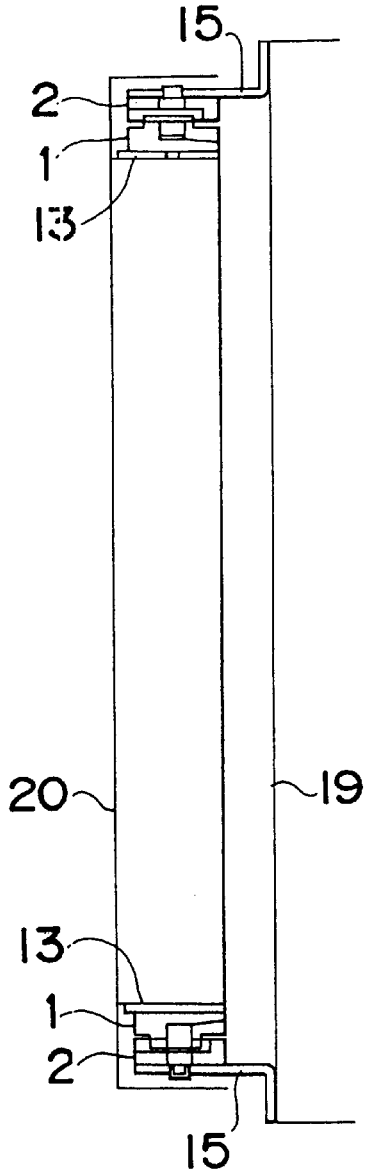
FIG. 19 is a side view of the door manual opening/closing device.
Figure 20:
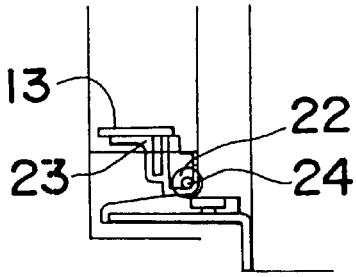
FIG. 20 is a sectional view taken along the line xx—xx in FIG. 19.

FIGS. 16A and 16B are views showing a state in which permanent magnets 21 magnetized alternately with a north pole and a south pole are mounted to a main body 19 and a door 20 and they are made to face each other. FIG. 16A shows a state in which the door is closed, while FIG. 16B shows a state in which the door is slightly opened from the right-hand side. In FIG. 16A, since the north pole and the south pole of the permanent magnets 21 mounted on the main body 19 face respectively the south pole and the north pole of the permanent magnet 21 mounted on the door 20, a mutually attracting force is exerted, thereby allowing the main body 19 and the door 20 to tightly contact each other.

In FIG. 16B, since the door 20 is slightly displaced rightward, the north pole and the south pole of the permanent magnet 21 mounted to the main body 19 face respectively the north pole and the south pole of the permanent magnet 21 mounted to the door 20, a mutually repelling force is exerted as a force for opening the door 20, which assists the user when opening the door 20. Conversely, when closing the door 20, a force for eventually recovering the state shown in FIG. 16A is exerted, and therefore, the door 20 can be surely closed.

FIGS. 17 through 20 are views showing a case where a guide roller 22 for restricting the door 20 in the horizontal direction is provided. In these figures, the slide cam 1 is mounted to door angles 13 provided at the door 20, while the lock cam 2 is mounted to a hinge angle 15 provided at the main body 19 after admitting the penetration of the hinge pin 14 mounted to the hinge angle 15. A roller base 23 is mounted to the door angle 13, and the guide roller 22 is put through an axial pin 24 provided at the roller base 23.

In the above case, when the door 20 is opened, the door 20 is slightly inclined due to a clearance between the hinge pin 14 and the slide cam 1, the weight of the door 20 itself and the weight of stores stored in the door 20. When the door 20 is closed, the inclination of the door 20 is restricted by a guide and the guide roller 22 mounted on the hinge angle 15 provided at a lower portion of the main body 19 to be put into a horizontal state, so that the axial centers of the right-hand and left-hand pivot axes can be aligned respectively for the achievement of smooth opening and closing operations.

Figure 21:
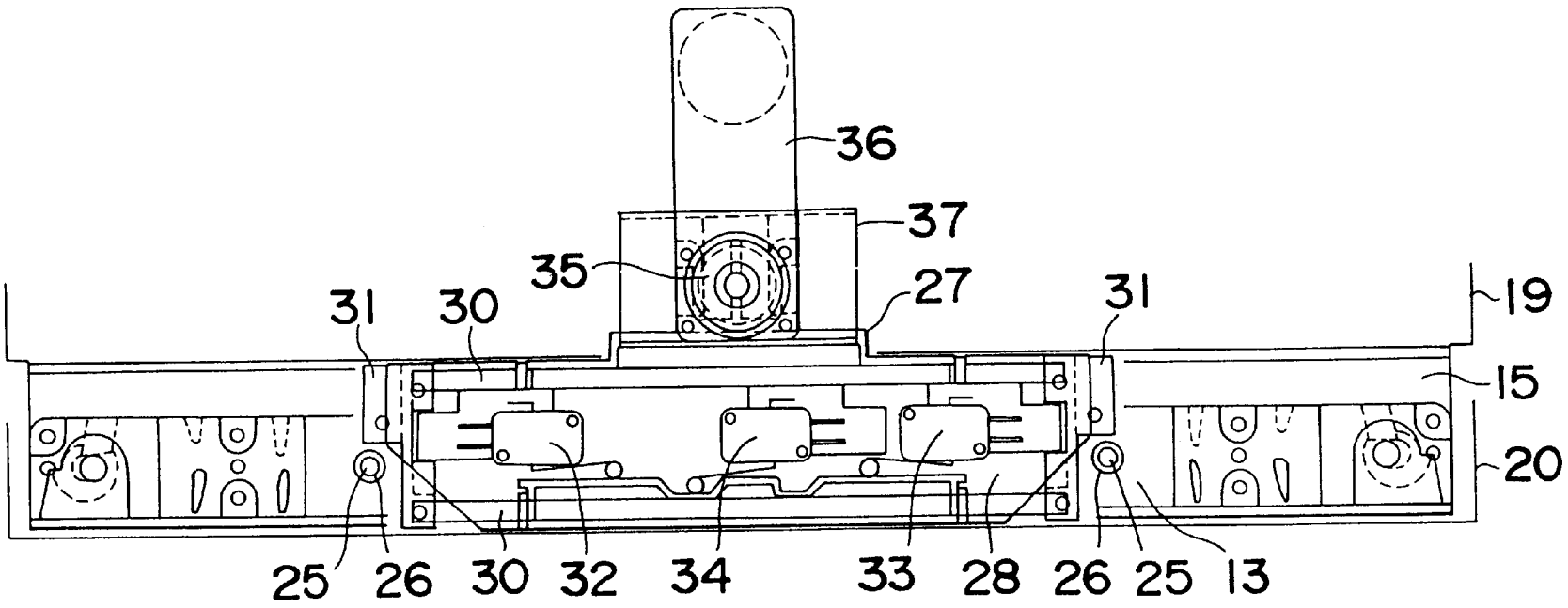
FIG. 21 is a plan view of an automatic door opening device.
Figure 22:
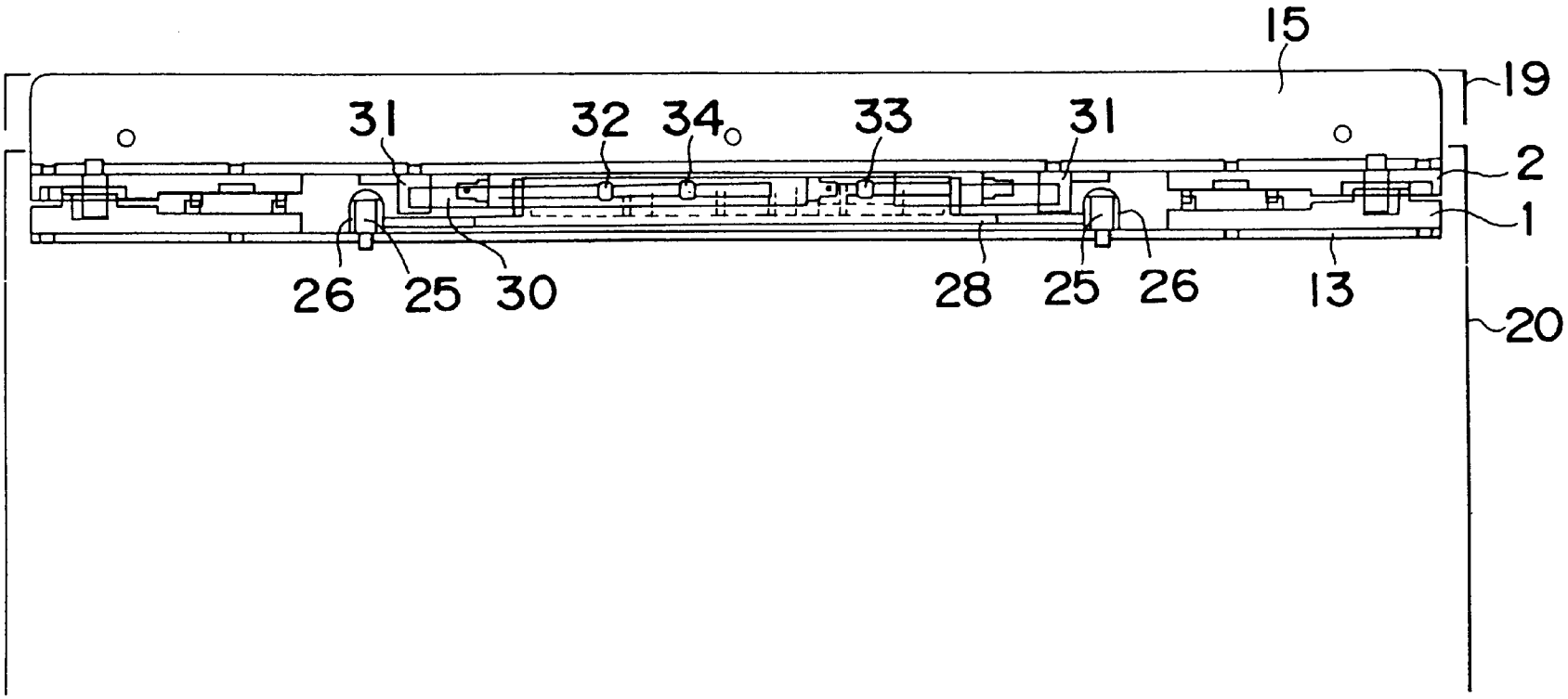
FIG. 22 is a front view of the automatic door opening device.
Figure 23:
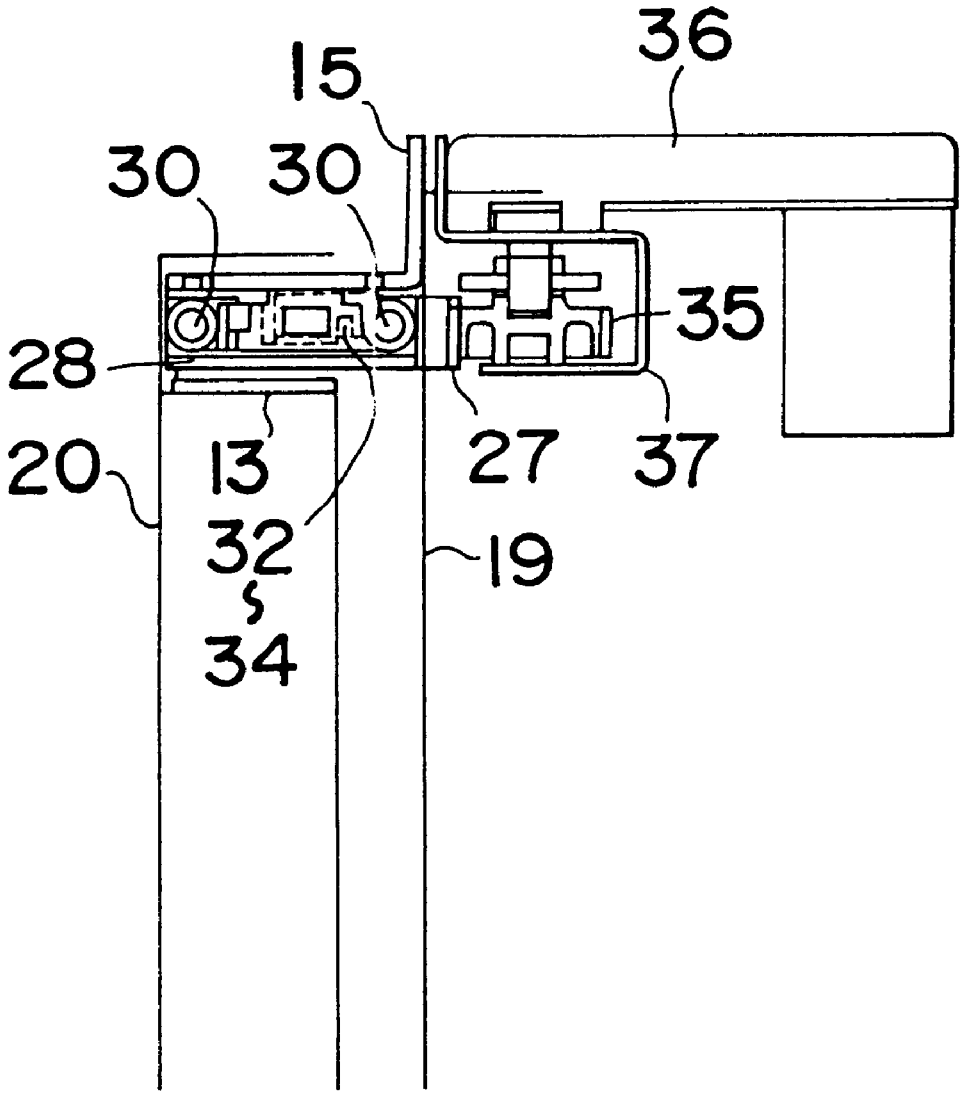
FIG. 23 is a side view of the automatic door opening device.

FIGS. 21 through 23 are views showing a powered mechanism for automatically opening the door 20, where FIG. 21 is a plan view, FIG. 22 is a front view and FIG. 23 is a side view. In these figures, a shaft support 31 is mounted to the hinge angle 15 provided at the main body 19, and guide shafts 30 are fixed to the shaft support 31. A slide plate 28 having a rack 27 is guided by the guide shaft 30 and is made slidable in its longitudinal direction.

Further, right-hand and left-hand detection switches 32 and 33 for detecting the acting position of the slide plate 28 and a standby switch 34 for detecting the standby position of the slide plate 28 are mounted to the hinge angle 15. A roller 26 is rotatably mounted to the door angle 13 provided at the door 20 by means of a securing pin 25. A drive motor 36 is mounted to a motor angle 37 provided at the main body 19. A pinion gear 35 is rotated by the drive motor 36, and the rotation is transformed into a liner movement by the rack 27, with the result that the slide plate 28 slides.

Figure 24A:
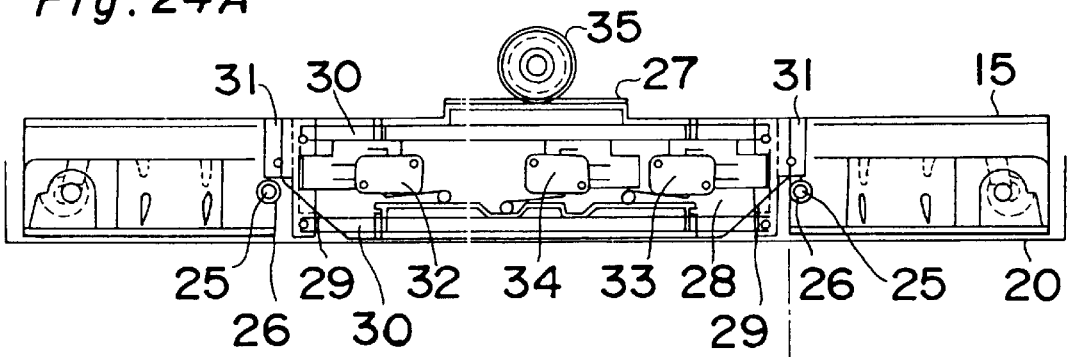
FIGS. 24A through 24C are views showing the operation of the automatic door opening device.
Figure 24B:
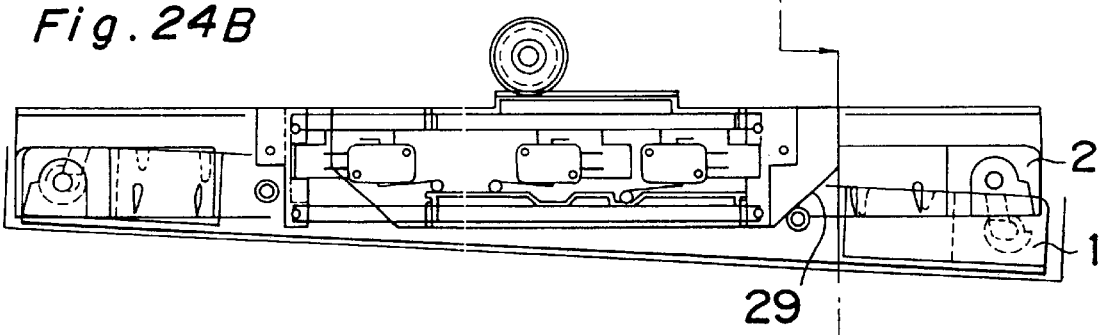
Figure 24C:
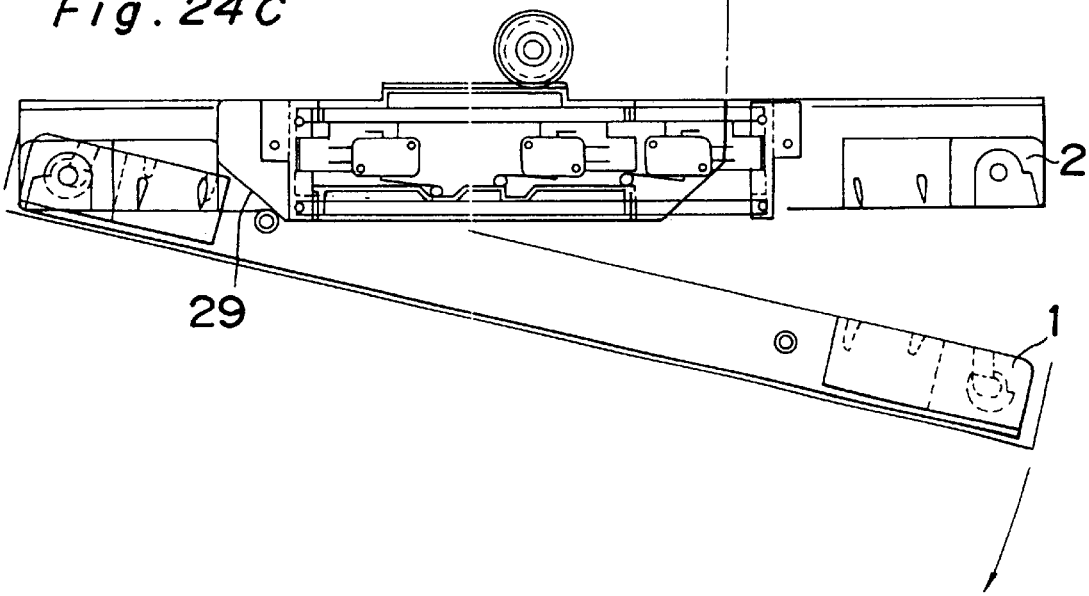
Figure 25B:
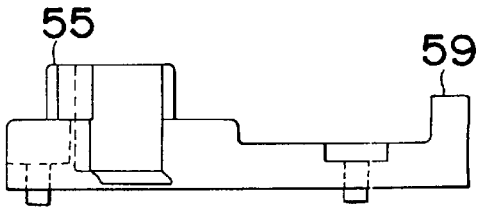
FIGS. 25A through 25F are views showing a slide cam of another embodiment of the present invention.
Figure 25A:
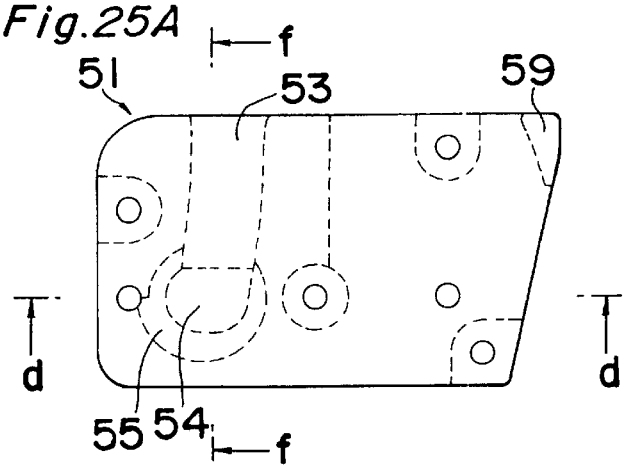
Figure 25E:
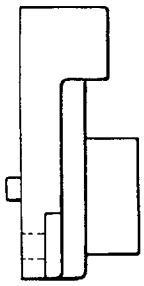
Figure 25F:
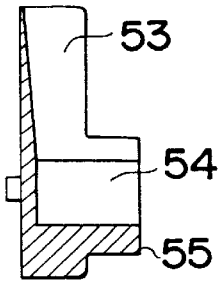
Figure 25C:
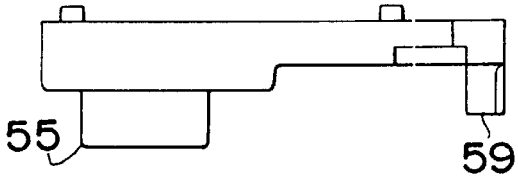
Figure 25D:
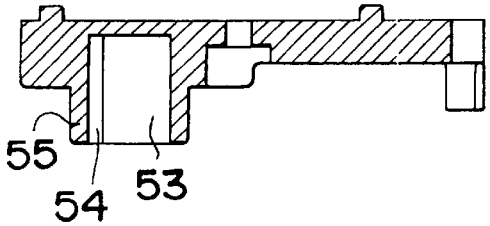
Figure 26B:
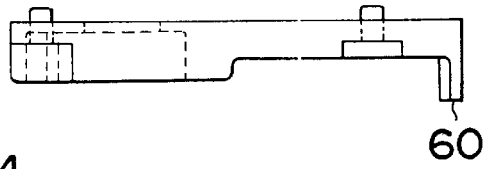
FIGS. 26A through 26F are views showing a lock cam of another embodiment of the present invention.
Figure 26A:
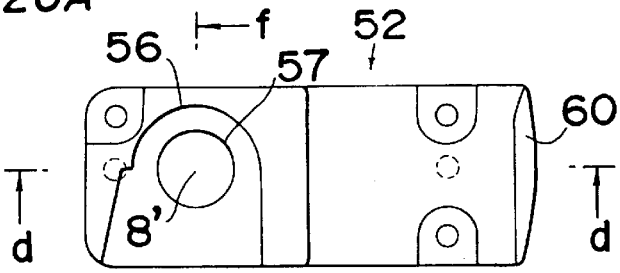
Figures 26E, 26F:
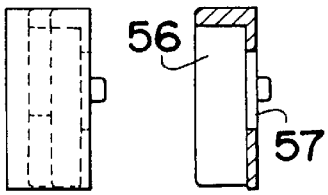
Figure 26C:
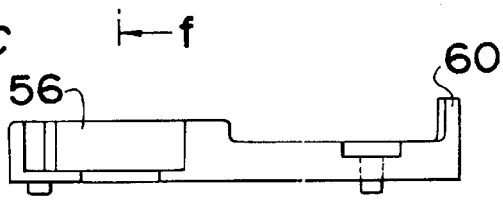
Figure 26D:
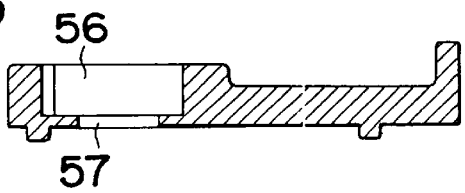
Figure 27B:
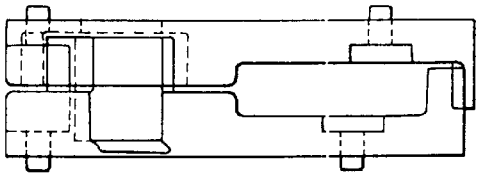
FIGS. 27A through 27F are views showing a state in which the slide cam and the lock cam are combined with each other.
Figure 27A:
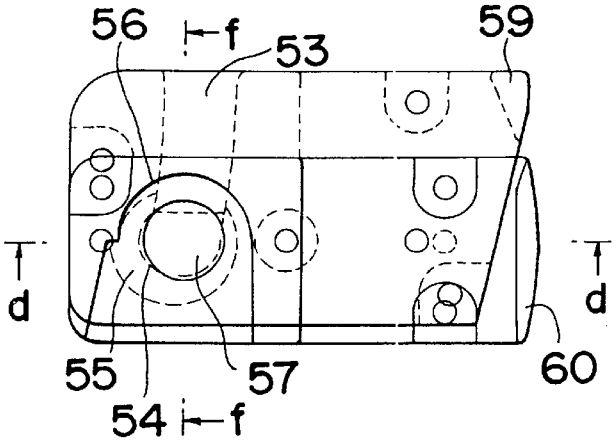
Figure 27E:
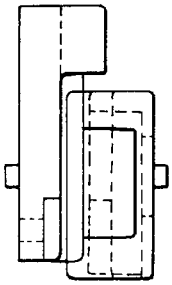
Figure 27F:
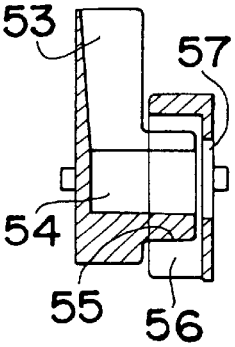
Figure 27C:
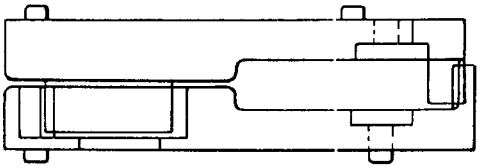
Figure 27D:
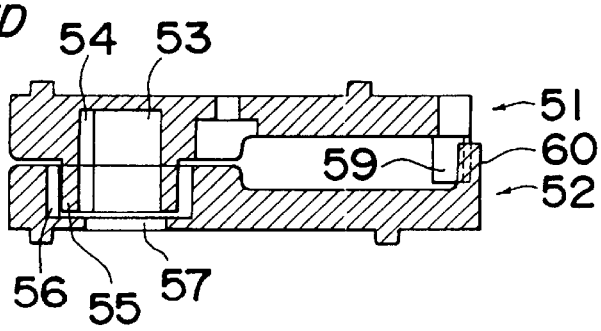

FIGS. 24A through 24C show the operation of the above powered mechanism. FIG. 24A shows a state in which the door 20 is closed, i.e., it is in a standby state. In this stage, the standby switch 34 is off, and the detection switches 32 and 33 are on.

When the user operates a touch switch or the like (not shown) provided on the door 20 or the surface of the main body 19 to issue a signal for opening the door 20 from the right-hand side, the pinion gear 35 is rotated in the counterclockwise direction by the drive motor 36 as shown in FIG. 24B, and the movement is transformed into a linear movement by the rack 27, with the result that the slide plate 28 slides rightward in FIG. 24B.

Then, a right-hand slide surface 29 provided at the slide plate 28 presses the right-hand roller 26, so that the door 20 is slightly opened. In this stage, the right-hand detection switch 33 is off, while the left-hand detection switch 32 and the standby switch 34 are on. According to FIG. 37 described later, the powered mechanism is restored in this stage into the state of FIG. 24A. However, according to the present embodiment, the door can be automatically opened wider by a further operation of the powered mechanism.

That is, as shown in FIG. 24C, when the slide plate 28 is slid leftward in the figure so that the left-hand slide surface 29 presses the left-hand roller 26, the door 20 can be further opened. In this stage, the left-hand detection switch 32 is off, while the right-hand detection switch 33 and the standby switch 34 are on. Subsequently, the user is required to manually open the door 20. The powered mechanism is now restored into the state shown in FIG. 24A. When the door 20 is opened from the left-hand side, an operation that is laterally symmetrical to the above operation is performed.

FIGS. 25A through 25F and FIGS. 26A through 26F show the main components of another embodiment of the present invention. FIGS. 25A through 25F are detailed views of the slide cam 51, while FIGS. 26A through 26F are detailed views of the lock cam 52. In FIGS. 26A through 26F, a hinge pin 14 which is provided at the main body side and will be described later penetrates a hole 57 provided at the lock cam 52, and its center axis coincides with the pivot axis 58.

In FIGS. 25A through 25F, a grooved cam 53 provided at the slide cam 51 guides the pivot axis 58, while a grooved cam 54 operates to guide the slide cam 51 into a position where the slide cam 51 is not disengaged from the pivot axis 58. similarly, a cam projection 55 provided at the slide cam 51 operates so that the slide cam 51 is not disengaged from the pivot axis 58 while being slidingly guided by a cam projection 56 provided at the lock cam 52 shown in FIGS. 26A through 26F according as the door is opened, thereby allowing the door to be prevented from falling off the main body.

Further, the slide cam 51 is provided with an outer cam 59 both side surfaces of which are formed into an arc shape, while the lock cam 52 is provided with an outer cam 60 both side surfaces of which are formed into an arc shape. They are slidingly guided as engaged with each other when the door is opened, so that the slide cam 51 is more surely guided into a position where the slide cam 51 is not disengaged from the pivot axis 58.

FIGS. 27A through 27F are views showing a state in which the slide cam 51 and the lock cam 52 are combined with each other. In the figures, the components are mutually related in position in the case where the door is completely closed.

Figures 28A, 28B, 28C, 28D:
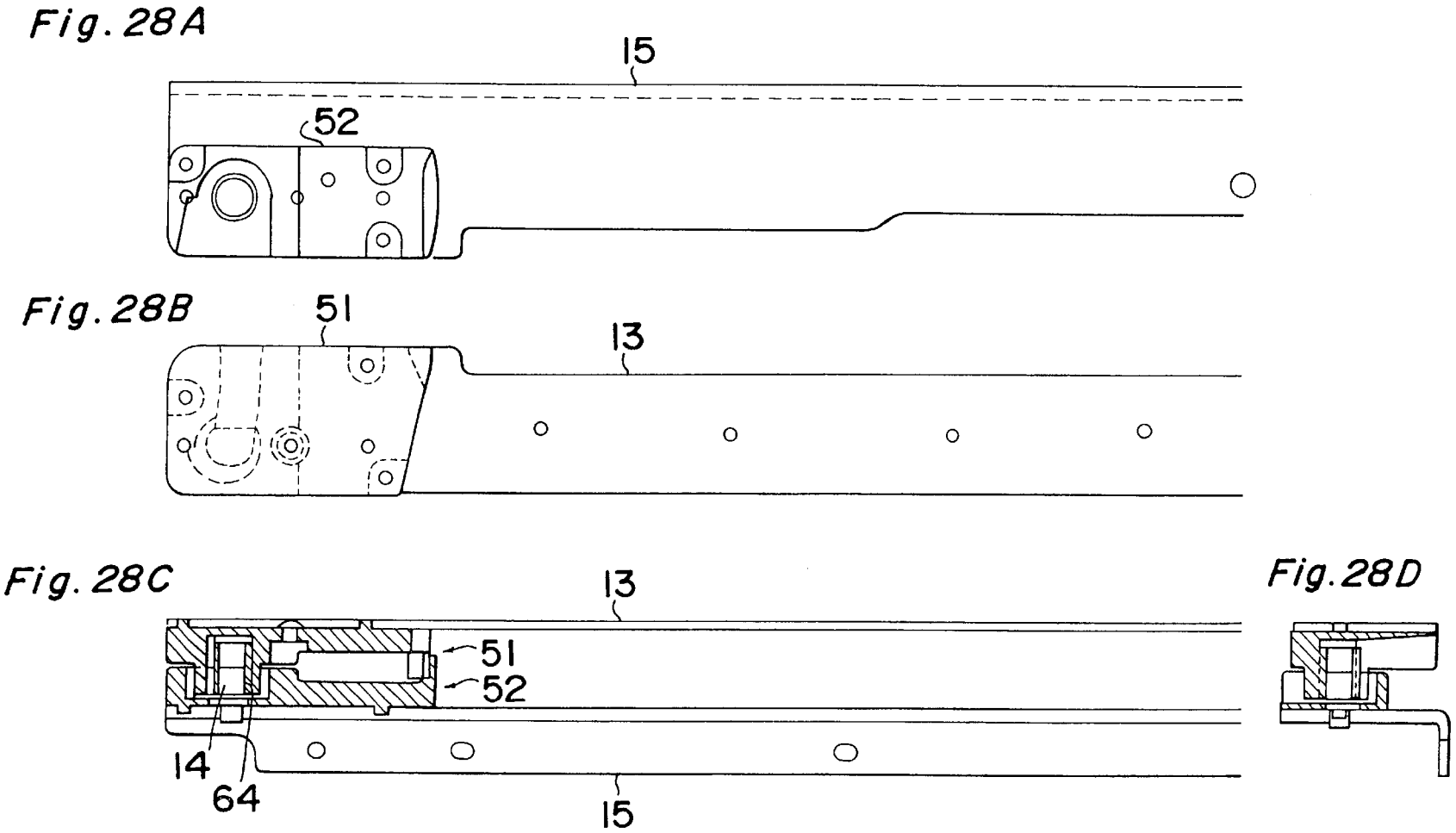
FIGS. 28A through 28D are views showing a state in which the slide cam and the lock cam are mounted to a mounting member.

FIGS. 28A through 28D are views showing a state in which the slide cam 51 and the lock cam 52 are mounted, where FIG. 28A is a plan view showing the mounting state of the lock cam 52, FIG. 28B is a plan view showing the mounting state of a slide cam 51, FIG. 28C is a front view and FIG. 28D is a side view. In the figures, the slide cam 51 is mounted to the door angle 13 provided at the door (not shown), while the lock cam 52 is mounted to a hinge angle 15 after admitting the penetration of both the hinge pin 14 mounted on the hinge angle 15 provided at the main body (not shown) and a roller 64 mounted rotatably by the hinge pin 14.

The present embodiment is provided with only one outer cam both side surfaces of which have an arc shape and which is provided at the slide cam 51 and the lock cam 52, thereby simplifying the component configuration. Further, the hinge pin 14 is provided with a roller 64, thereby allowing smooth opening and closing of the door and reducing a friction noise generated in opening and closing the door.

Figures 29A, 29B, 29C, 29D, 29E, 29F, 29G:
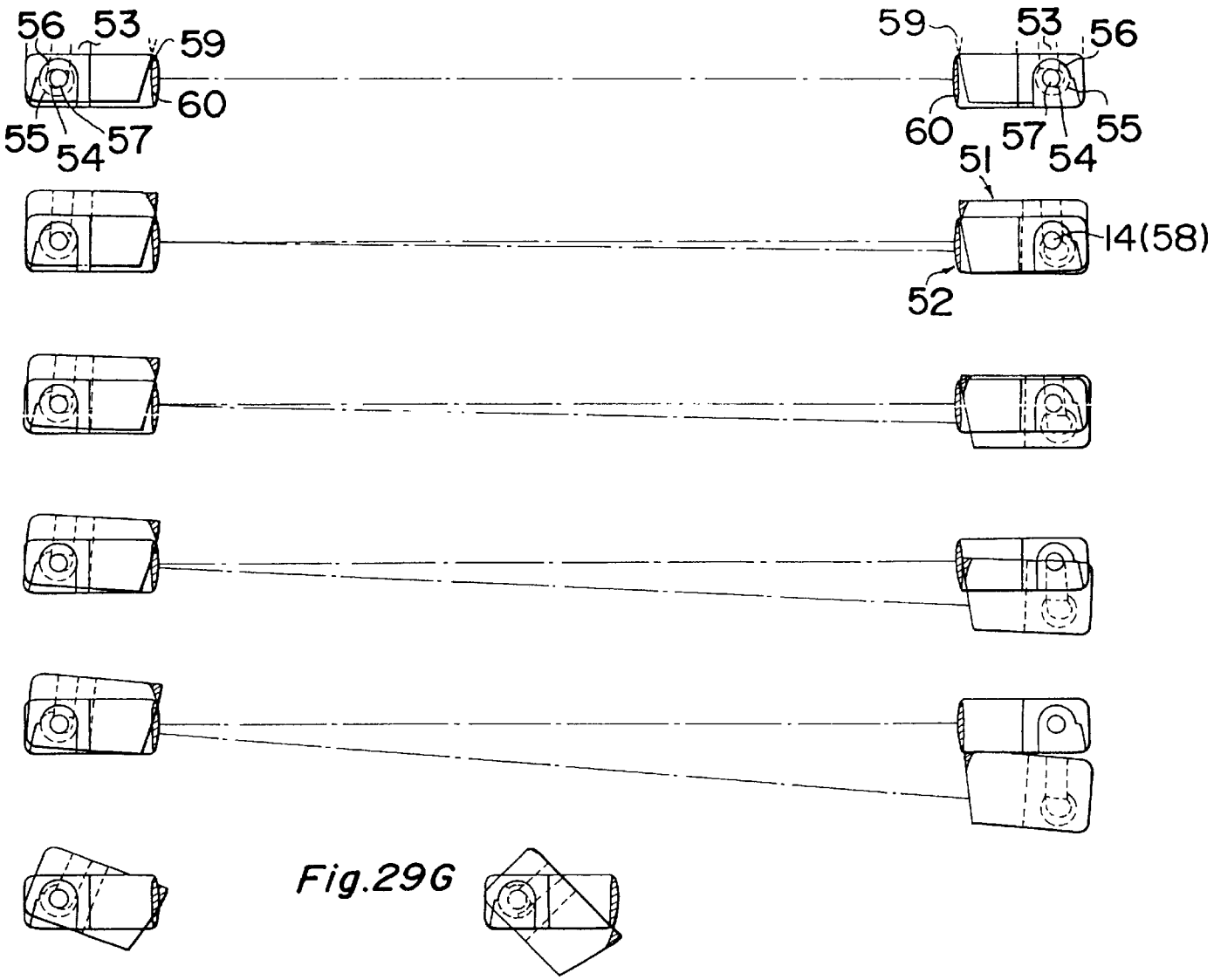
FIGS. 29A through 29G are views showing the movements of the slide cam and the lock cam in opening the door at the right-hand side.
Figures 30A, 30B, 30C, 30D, 30E, 30F, 30G, 30H:
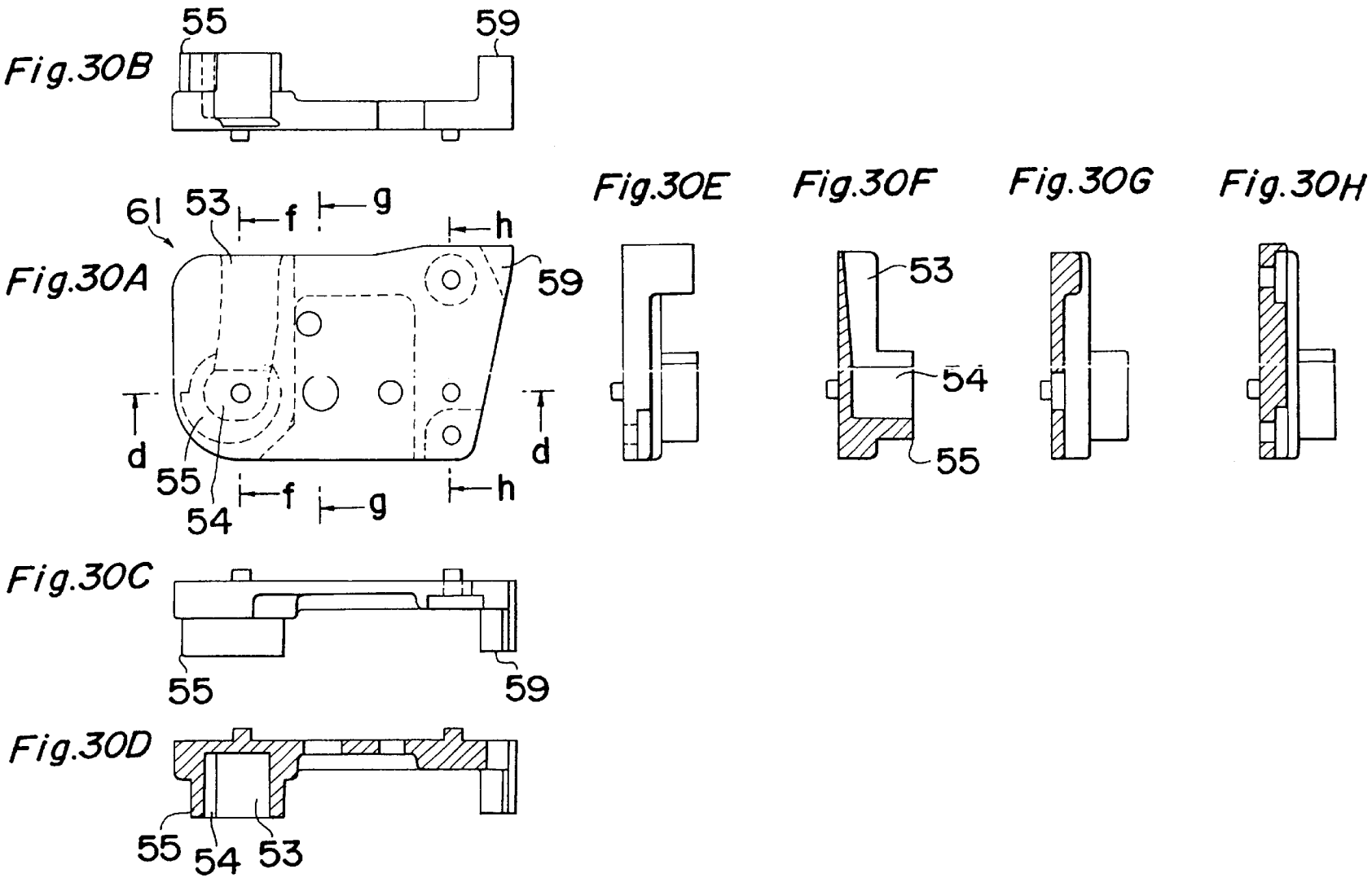
FIGS. 30A through 30H are views showing a slide cam of yet another embodiment of the present invention.
Figures 31A, 31B, 31C, 31D, 31E, 31F, 31G, 31H, 31I, 31J:
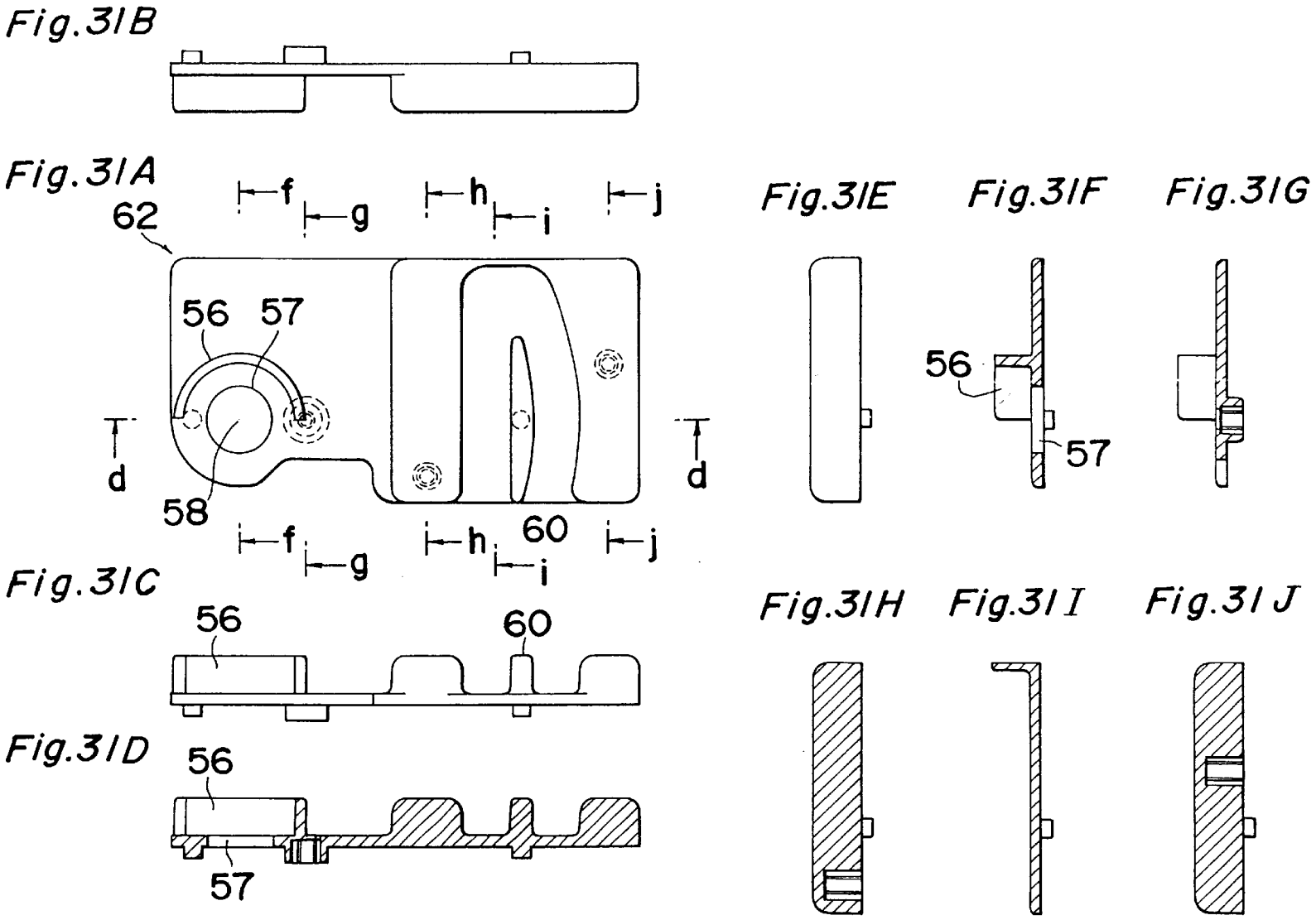
FIGS. 31A through 31J are views showing a lock cam of yet another embodiment of the present invention.
Figures 32A, 32B, 32C, 32D, 32E, 32F, 32G:
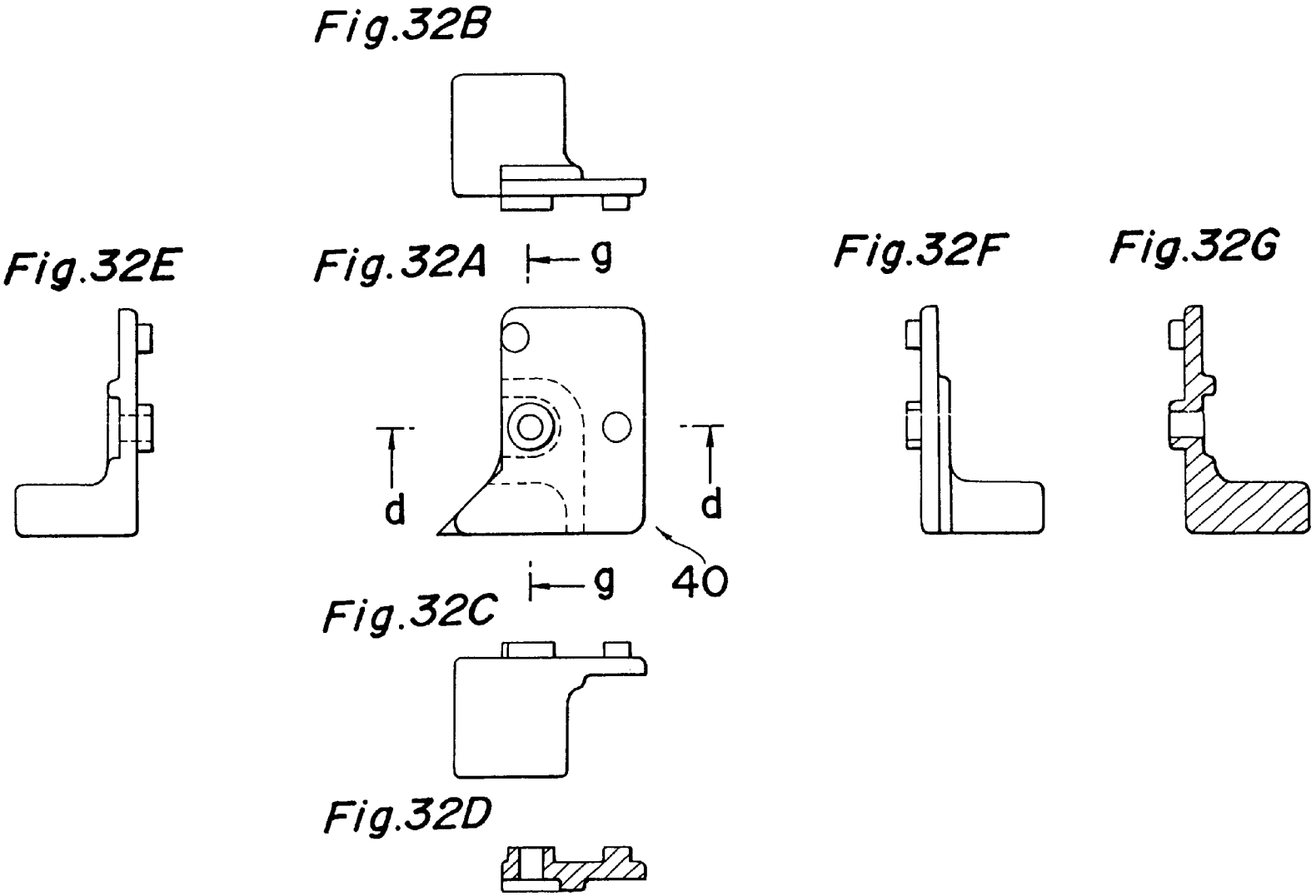
FIGS. 32A through 32G are views showing a stopper of yet another embodiment of the present invention.

FIGS. 29A through 29G are plan views of a state in which different-hand component combinations of the slide cam 51 and the lock cam 52 are arranged in laterally symmetrical positions, thereby forming a door hinge capable of being opened at the right-hand and left-hand sides, and show an operation in the case where the door is opened from the right-hand side. FIG. 29A shows a state in which the door is completely closed, where the slide cam 51 mounted on the door side and the lock cam 52 mounted on the main body side are combined with each other completely in a laterally symmetrical style.

In this stage, the grooved cams 53 provided at the right-hand and left-hand slide cams 51 are formed so that they are directed obliquely inwardly with respect to the door and restricted by the respective hinge pins 14 and rollers 64. Therefore, the door does not fall off the main body even when the user pulls the door frontward from both the right-hand and left-hand sides.

FIG. 29B shows a state in which the door starts to open from the right-hand side, where the grooved cam 53 provided at the right-hand slide cam 51 is disengaged from the hinge pin 14 that is penetrating the hole 57 provided at the right-hand lock cam 52.

In this stage, the grooved cam 53 guided by the hinge pin 14 slides the door slightly rightward. Consequently, the grooved cam 54 provided at the left-hand slide cam 51 and the hinge pin 14 that is penetrating the hole 57 provided at the left-hand lock cam 52 are mutually related in position so that the slide cam 51 is not disengaged from the left-hand pivot axis 58.

Further, in this stage, the outer cam 59 provided at the right-hand slide cam 51 and the outer cam 60 provided at the right-hand lock cam 52 are slidingly guided as engaged with each other. Therefore, the right-hand slide cam 51 is more surely guided into a position where it is not disengaged from the pivot axis 58.

Further, according as the door pivots as shown in FIGS. 29C and 29D, the cam projection 55 provided at the left-hand slide cam 51 is slidingly guided by the cam projection 56 provided at the left-hand lock cam 52 to operate so that the slide cam 51 is not disengaged from the left-hand pivot axis 58, thereby preventing the door from falling off the main body and allowing the opening and closing of the door to be surely performed.

Further, according as the door pivots as shown in FIGS. 29C and 29D, the engagement of the outer cam 59 provided at the right-hand slide cam 51 with the outer cam 60 provided at the right-hand lock cam 52 progresses, according to which the outer cam 59 provided at the left-hand slide cam 51 starts to be engaged with the outer cam 60 provided at the left-hand lock cam 52.

When the door further pivots as shown in FIG. 29E, the outer cam 59 provided at the right-hand slide cam 51 is disengaged from the outer cam 60 provided at the right-hand lock cam 52, while the engagement of the outer cam 59 provided at the left-hand slide cam 51 with the outer cam 60 provided at the left-hand lock cam 52 progresses.

Further, in FIG. 29F, the outer cam 59 provided at the left-hand slide cam 51 is completely engaged with the outer cam 60 provided at the left-hand lock cam 52. When the door pivots into a position as shown in FIG. 29G, the outer cam 59 provided at the left-hand slide cam 51 is disengaged from the outer cam 60 provided at the left-hand lock cam 52.

By the above operation, the door can be prevented from falling off the main body and the opening and closing of the door can be surely performed. When the door is opened from the left-hand side, an operation that is laterally symmetrical to the above operation is performed.

FIGS. 30A through 30H through FIGS. 32A through 32G show the main components of another embodiment of the present invention. FIGS. 30A through 30H are detailed views of a slide cam 61 to be mounted on the door side, while FIGS. 31A through 31J are detailed views of a lock cam 62 to be mounted on the main body side. In FIGS. 31A through 31J, a hole 57 provided at the lock cam 62 is penetrated by a hinge pin 14 which is provided on the main body side as will be described later, and its center axis coincides with the pivot axis 58.

In FIGS. 30A through 30H, a grooved cam 53 provided at the slide cam 61 guides the pivot axis 58, while a grooved cam 54 operates to guide the slide cam 61 into a position where the slide cam 61 is not disengaged from the pivot axis 58. Similarly, the cam projection 55 provided at the slide cam 61 operates so that the slide cam 61 is not disengaged from the pivot axis 58 while being slidingly guided by a cam projection 56 provided at the lock cam 62 shown in FIGS. 26A through 26F according as the door is opened, thereby allowing the door to be prevented from falling off the main body.

Further, the slide cam 61 is provided with an outer cam 59 both side surfaces of which are formed into an arc shape, while the lock cam 62 is provided with an outer cam 60 both side surfaces of which are formed into an arc shape. They are slidingly guided as engaged with each other when the door is opened, with the result that the slide cam 61 is more surely guided into a position where the slide cam 61 is not disengaged from the pivot axis 58.

FIGS. 32A through 32G are views showing a stopper 40 which is a component having the role of preventing the door provided at the slide cam 61 from opening further than a certain degree.

Figure 33C:
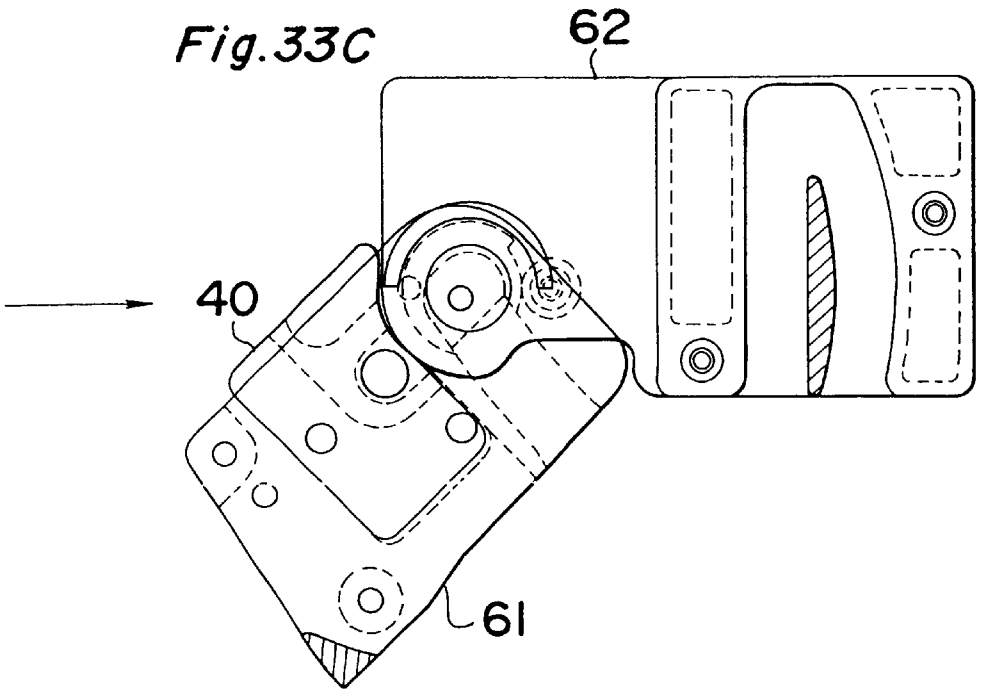
FIGS. 33A through 33C are views showing a state in which the slide cam, the lock cam and the stopper are combined with one another.
Figure 33B:
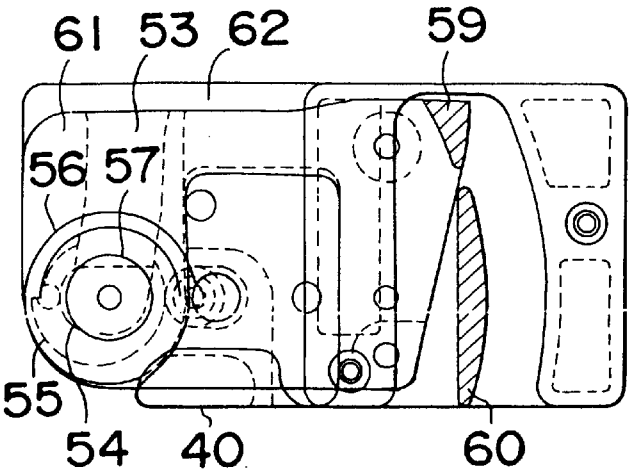
Figure 33A:
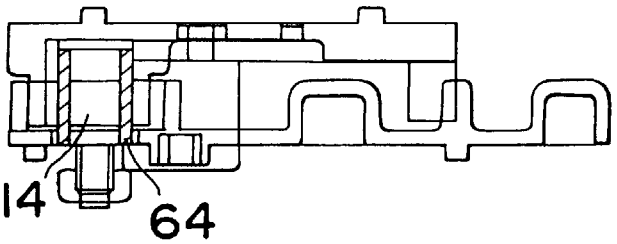

FIGS. 33A through 33C are views showing a state in which the slide cam 61, the lock cam 62 and the stopper 40 are combined with one another, where FIG. 33A is a front view, FIG. 33B is a plan view and FIG. 33C is a plan view showing a positional relation of the components in a state in which the door is completely opened. In FIGS. 33A and 33B, the components are related in position in the case where the door is completely closed.

In FIG. 33A, the slide cam 61 is mounted to a door angle (not shown) provided at a door (not shown), while the lock cam 62 is mounted to a hinge angle (not shown) after admitting the penetration of both a hinge pin 14 mounted to the hinge angle provided at the main body (not shown) and a roller 64 which is mounted rotatably by the hinge pin 14.

As shown in FIG. 33C, when the door is opened and pivoted by, for example, 135°, the stopper 40 mounted to the slide cam 61 abuts against the side surface of the lock cam 62, with the result that the pivoting of the door stops to be completely opened. According to the present embodiment, with the arrangement that the end surface of the outer cam 60 both side surfaces of which have an arc shape and which is provided at the lock cam 62 has a rounded shape as shown in FIGS. 31A through 31J and three walls are provided on three sides of the outer cam 60, the user is protected from being injured by the outer cam 60 when touching it and the outer cam 60 is scarcely damaged by an external force.

Figure 34A:
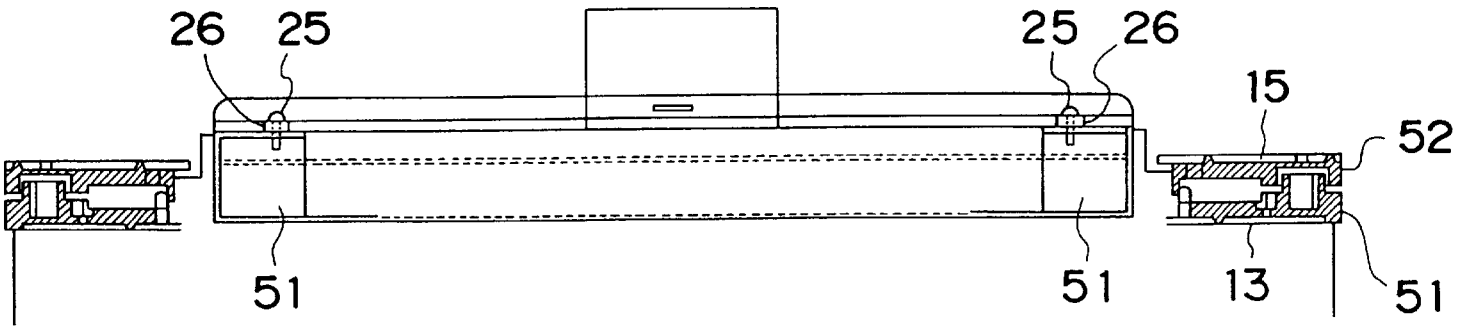
FIGS. 34A through 34C are views showing another automatic door opening device.
Figure 34B:
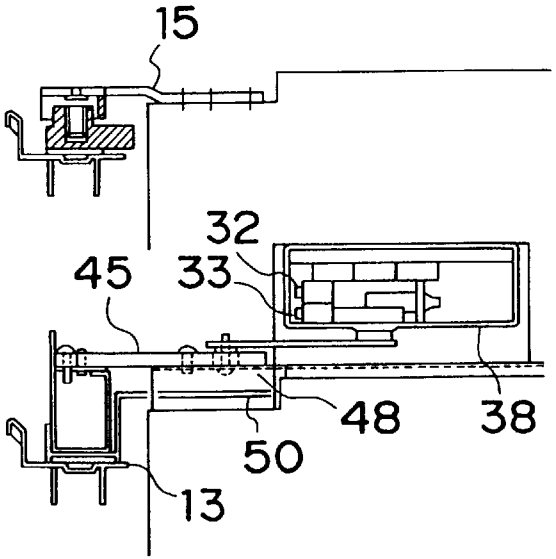
Figure 34C:
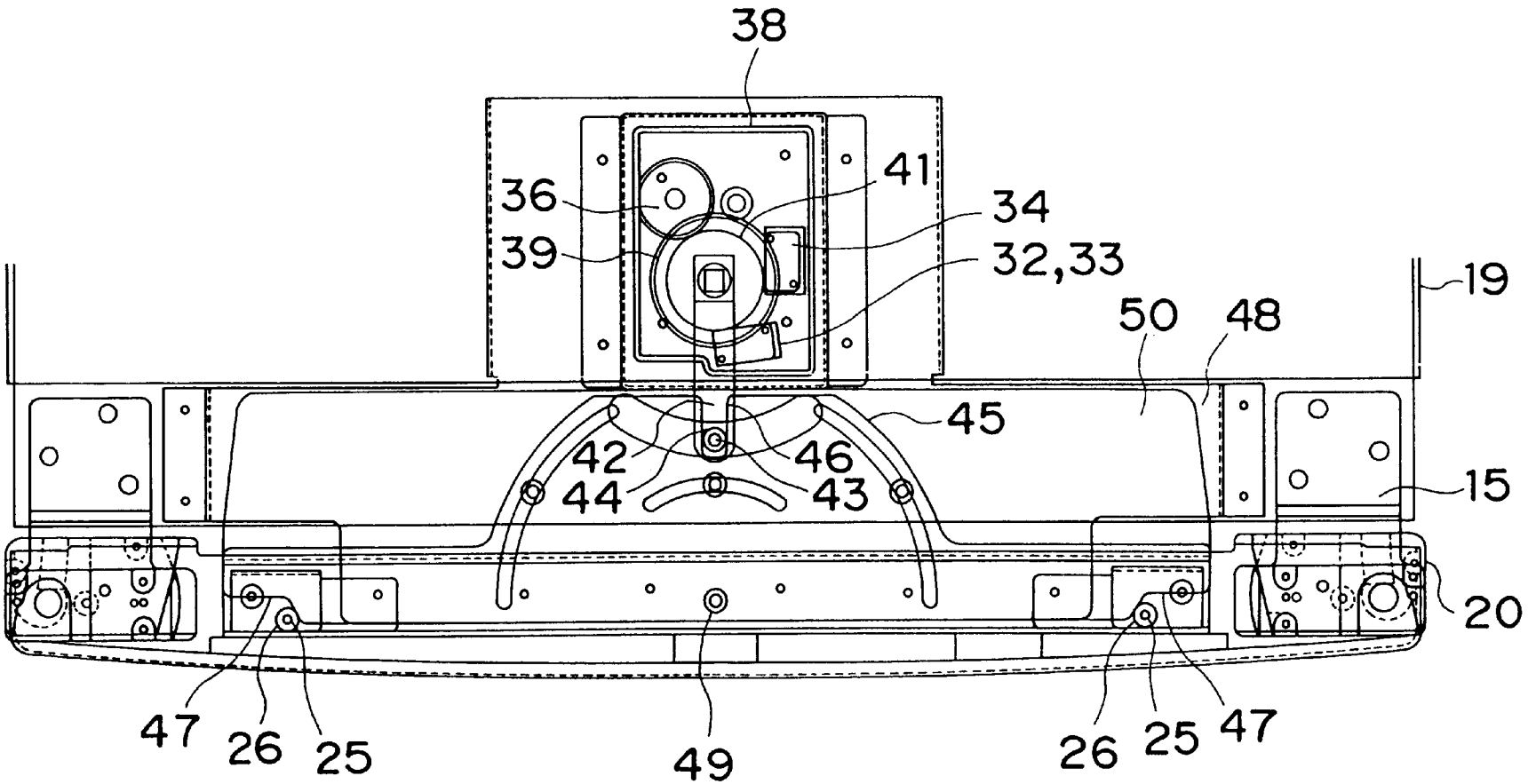

FIGS. 34A through 34C are views showing a powered mechanism for automatically opening the door 20, where FIG. 34A is a front view, FIG. 34B is a side view and FIG. 34C is a plan view. In this case, there is a construction different from the construction described with reference to FIGS. 21 through 24A through 24C. In FIGS. 34A through 34C, a turning plate 45 is mounted to a chassis 48 provided at the main body 19 in a manner that it can pivot around a pivot axis 49. Further, a drive motor 36 is mounted inside a drive unit 38 mounted on the chassis 48. This drive motor 36 rotates a gear 39 so as to pivot a lever 42.

Detection switches 32 and 33 for detecting the acting position of the lever 42 and a standby switch 34 for detecting the standby position of the lever 42 are mounted inside the drive unit 38, and a turning-on and -off operations of the switches are performed by a notch provided at a rotary cam 41 interlocked with the gear 39. Further, a roller 26 is mounted rotatably by a securing pin 25 to a bracket 51 which is mounted to the door 20 together with a cover 50.

In FIGS. 34A through 34C, the door 20 is in a closed state, i.e., in a standby state in which the above mechanism stands by. In this stage, the standby switch 34 is off, while the detection switches 32 and 33 are on.

Figure 35:
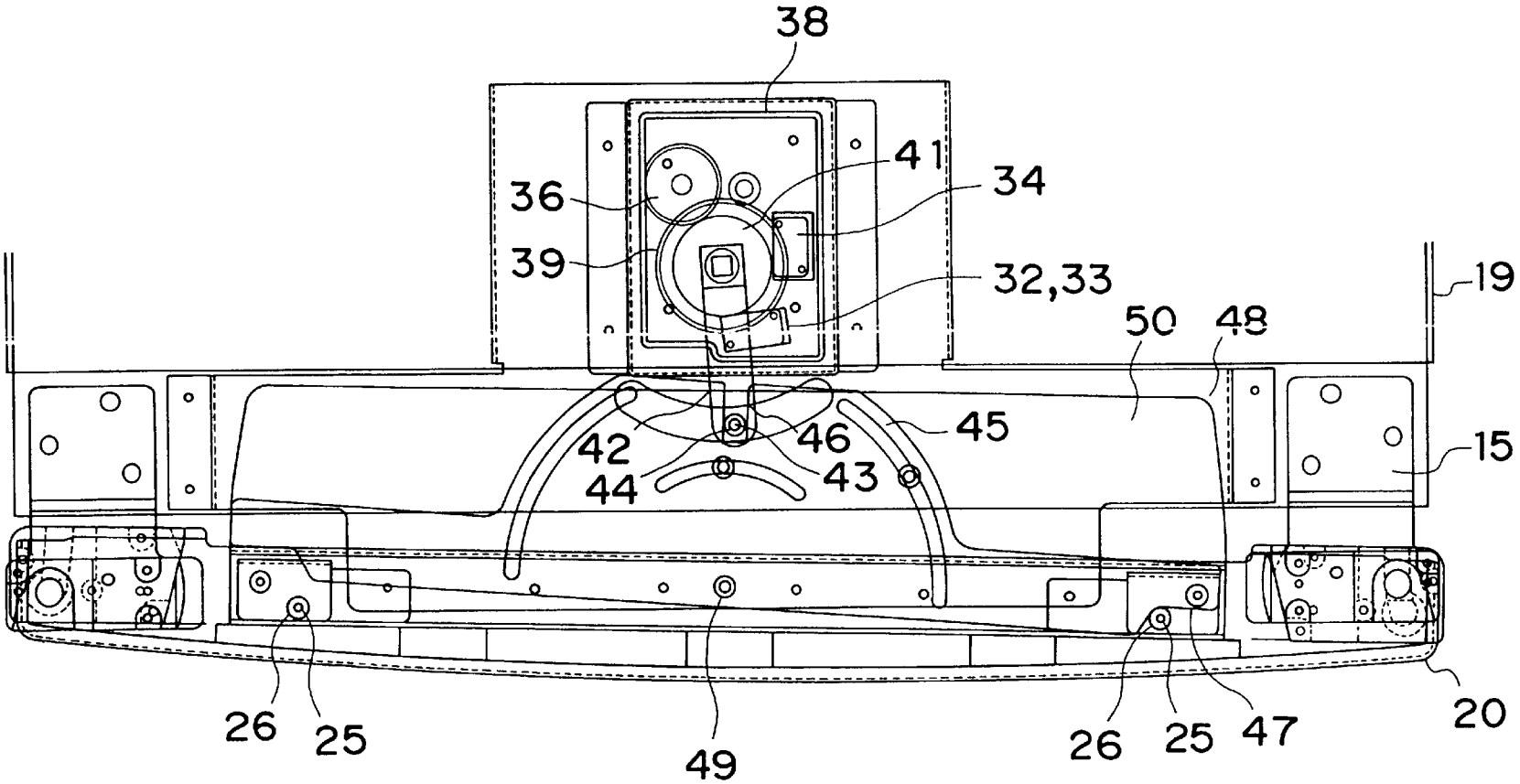
FIG. 35 is a view showing the operation of the automatic door opening device.

When the user operates a touch switch or the like (not shown) provided on the door 20 or the surface of the main body 19 to issue a signal for opening the door 20 from the right-hand side, the gear 39 is rotated in the counterclockwise direction by the drive motor 36 to pivot the lever 42 counterclockwise as shown in FIG. 35. A roller 44 is mounted rotatably by a securing pin 43 to the tip end of the lever 42, and the roller 44 presses a groove 46 provided at the turning plate 45 in the radial direction toward the pivot axis 49 according as the lever 42 pivots, with the result that the turning plate 45 turns clockwise around the pivot axis 49.

Then, a right-hand slide surface 47 provided at the rotary plate 45 presses the right-hand roller 26, so that the door 20 is slightly opened. In this stage, the detection switches 32 and 33 and the standby switch 34 are all on.

Figure 36:
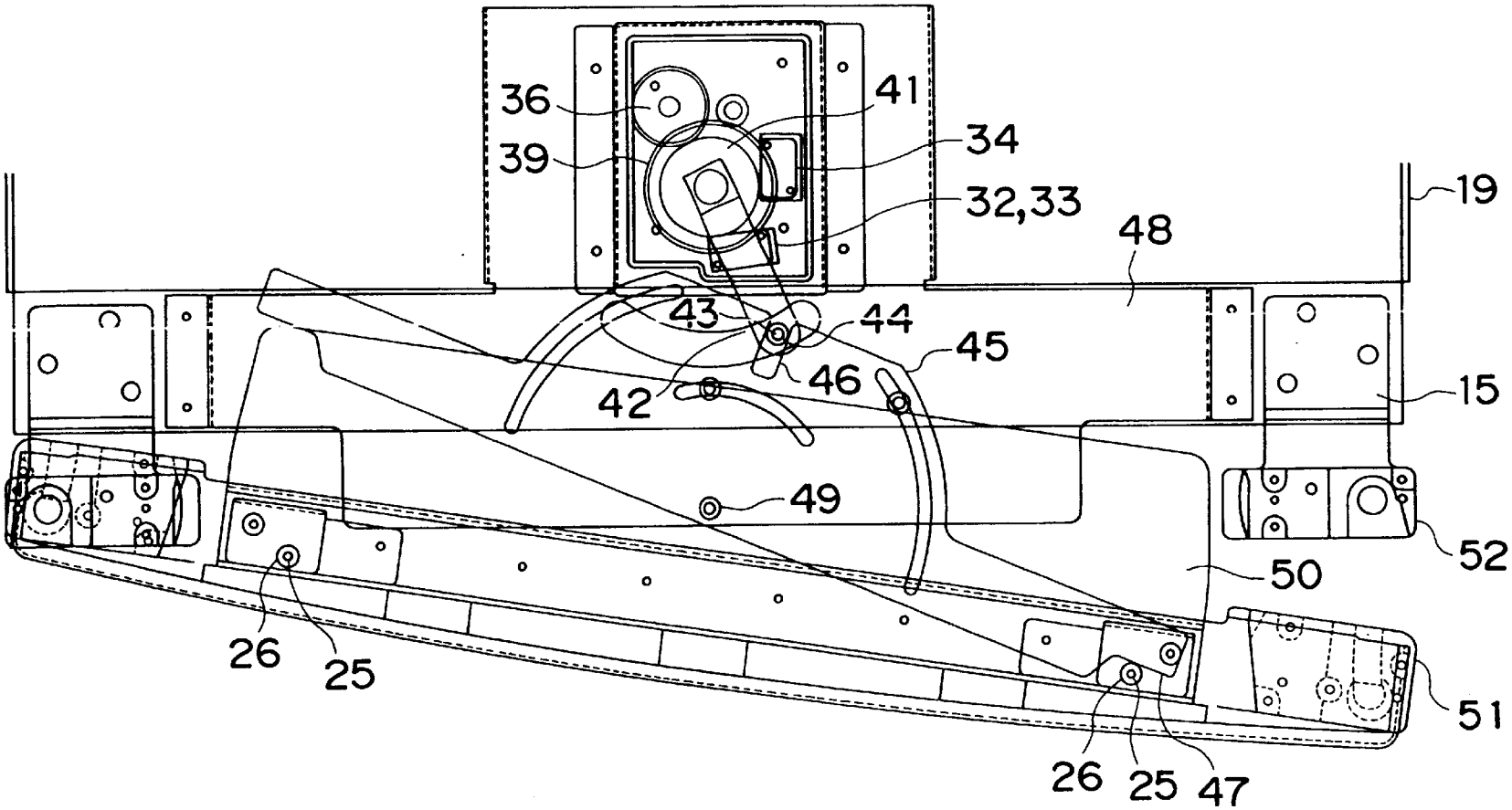
FIG. 36 is a view showing the operation of the automatic door opening device.

As shown in FIG. 36, when the lever 42 further pivots counterclockwise and the turning plate 45 turns clockwise, the door 20 is maximally opened by this mechanism, then the detection switch 33 is off and the detection switch 32 and the standby switch 34 are on. Subsequently, the user is required to manually open the door 20. The above mechanism is restored into the state shown in FIGS. 34A through 34C. When the door 20 is opened from the left-hand side, an operation that is laterally symmetrical to the above operation is performed.

Figure 37:
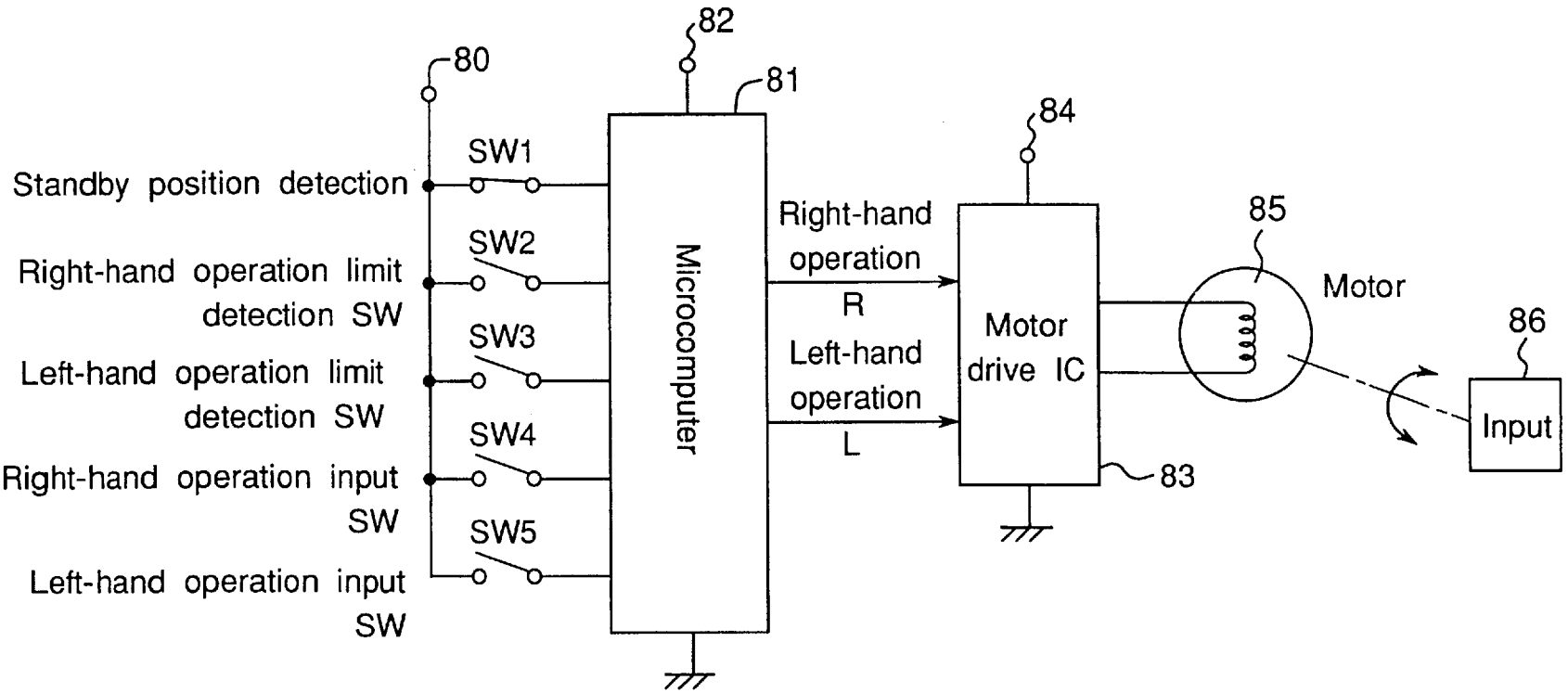
FIG. 37 is a circuit diagram showing the structure of an electric circuit of a powered mechanism.

FIG. 37 shows the construction of an electric circuit of the powered mechanism. The reference numeral 81 denotes a microcomputer which operates according to a program in response to signals from a standby position detection switch SW1, a right-hand action limit detection switch SW2, a left-hand action limit detection switch SW3, a right-hand action input switch SW4, a left-hand action input switch SW5 and so forth.

The reference numeral 83 denotes a motor drive circuit, and the reference numeral 85 denotes a motor. The reference numeral 86 shows a mechanism section to be driven by the motor. The motor 85, mechanism section 86, switches SW1, SW2 and SW3 correspond to the switches, motor and so forth (note that the reference numerals are different) shown in FIGS. 34A through 34C. In FIG. 37, the reference numerals 80, 82 and 84 denote electric power source connection terminals.

Figure 38:
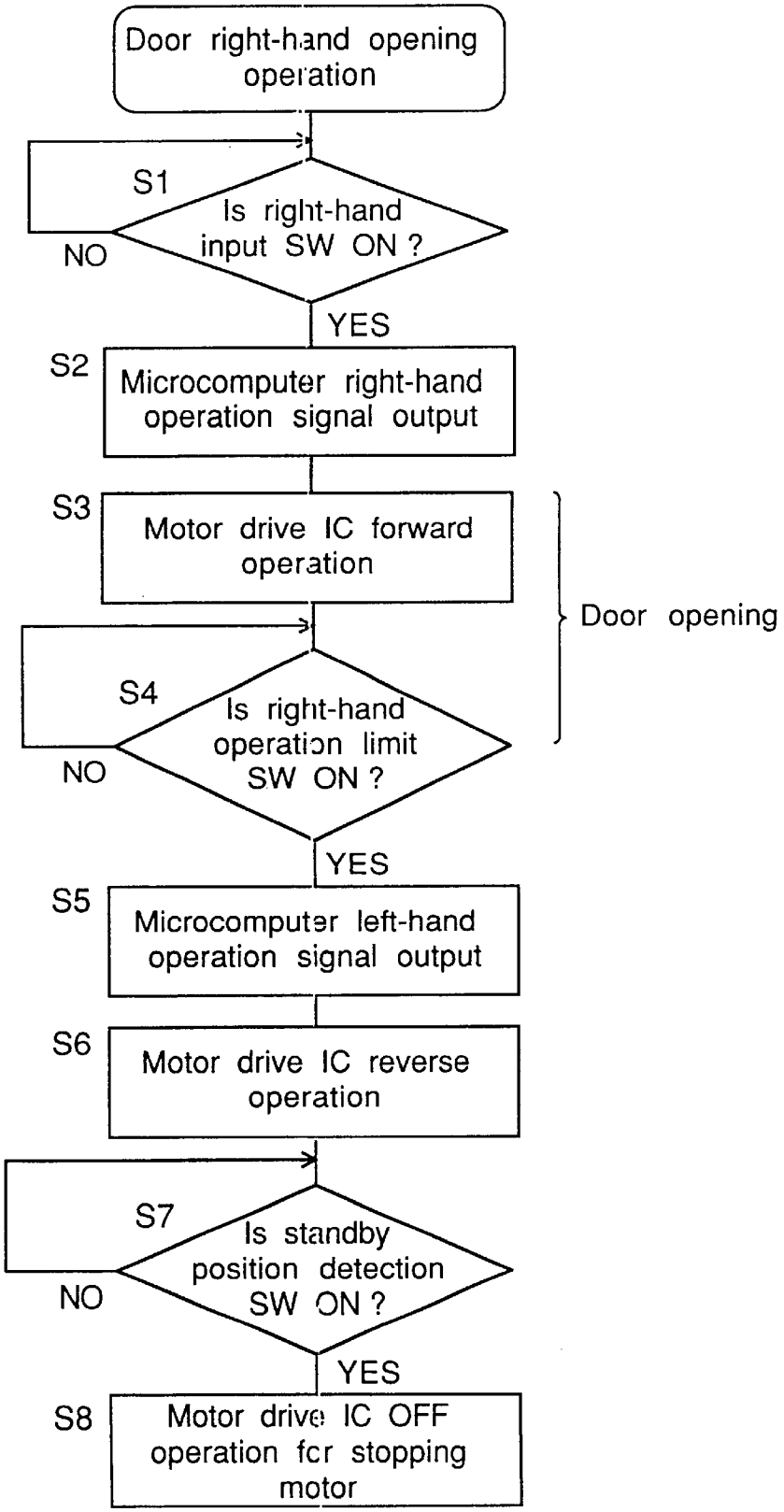
FIG. 38 is a flowchart of a control operation of the powered mechanism.

FIG. 38 shows a flowchart of a door right-hand opening operation by the microcomputer. First, when the right-hand operation input switch SW4 is turned on in Step S1, the program flow proceeds to Step S2 to output a right-hand operation signal R. By this operation, the motor drive circuit 83 drives the motor 85 forwardly (S3). This driving continues until the right-hand action limit switch SW2 will be turned off (S4).

Through the operations in Steps S3 and S4, the door opens from the right-hand side. Subsequently, the program flow proceeds to Step S5, in which the microcomputer 81 outputs a left-hand operation signal L. By this operation, the motor drive circuit 83 reverses the motor 85. Subsequently, when the standby position detection switch is turned on in Step S7, the motor drive is stopped (S8). When the door is opened at the left-hand side, an operation similar to the operation shown in FIG. 38 is executed.

Although the slide cam is provided on the door side and the lock cam is provided on the main body side in the above description, the present invention is not limited this, and it is acceptable to provide the slide cam on the main body side and provide the lock cam on the door side.

As described above, according to the present invention, the closing of the door is performed by the engagement of the cam mechanism. Therefore, when opening the door in this closed state, the door can be opened with a relatively small force. Also, the door can be closed with a small force. Furthermore, since the opening and closing of the door is performed by the engagement and disengagement of the cam mechanism, a small operating noise (mechanical noise) results. Furthermore, the door does not fall off in the closing stage and the opening stage.

Furthermore, according to the present invention, the door can be easily opened and closed from either the right-hand side or the left-hand side, and the right-hand and left-hand mechanical components are independent of each other. Accordingly, there are achieved a reduced number of components and a simple assembling work, and this produces the effect that the component cost and the assembling cost are inexpensive. Furthermore, the arrangement also has the advantage that the space occupied by the whole mechanism with respect to the door is small.

Particularly, according to the first aspect of the present invention, which is provided with the first engagement position and the second engagement position, the door is closed in the first engagement position and the door is pivotally locked in the second engagement position on the closed side. With this arrangement, the cam mechanism can be easily released from the first engagement position, and the closed side of the door can surely serve as a pivot axis in the door opening stage. This arrangement produces the effect that it requires only a reduced number of components and a simple mechanism in spite of the fact that it is a double swing door system.

According to the third aspect of the present invention, the locking of the cam mechanism is secured by the hinge pin, and a good pivot axis is achieved. According to the forth aspect of the present invention, the present invention can be easily implemented. According to the sixth aspect of the present invention, the closing of the door in the first engagement position is ensured and made stable. According to the eighth aspect of the present invention, the pivoting in the second engagement position is performed smoothly.

According to the ninth aspect of the present invention, the structure of the fourth aspect for preventing the door from falling off and maintaining the door in the second engagement position is ensured. According to the tenth aspect of the present invention, the structure for preventing the door from falling off and maintaining the door in the second engagement position is implemented by a reduced number of components.

According to the eleventh aspect of the present invention, the structure for preventing the door from falling off and maintaining the door in the second engagement position is ensured. According to the twelfth aspect of the present invention, a durability of the base portion is obtained, so that the door opening/closing mechanism is made to have a longer operating life.

According to the fourteenth aspect of the present invention, an operating force in opening and closing the door is assisted, and therefore, the opening and closing of the door can be performed smoothly and the closed state is ensured.

According to the fifteenth through seventeenth aspects of the present invention, at least the start on opening the door is achieved only by operating the operating members such as the switches, which is convenient.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus comprising: cam mechanisms which are respectively provided on a right-hand and left-hand side of a door and cause the door to be engaged with and disengaged from a main body, the cam mechanisms including means for assuming a first engagement positions, which is symmetrically arranged on the right-hand and left-hand sides of the door, and a second engagement position which is symmetrically arranged on the right-hand and left-hand sides of the door, wherein the right-hand and left-hand cam mechanisms are placed in the first engagement position when the door is closed, and the door slides when the door is opened at one side of the right-hand side and the left-hand side of the door, so that the cam mechanism at the other side is placed in the second engagement position and is pivotally locked in the second engagement position.

2. An apparatus as claimed in claim 1, wherein the cam mechanism is comprised of a lock cam member provided on the main body side and a slide cam member provided on the door side.

3. An apparatus as claimed in claim 2 wherein the slide cam member includes a first groove and a second groove and a projection provided around the second groove.

4. An apparatus of claim 3 wherein the first groove has a depth that varies and the projection has a snail shape with an increased diameter at an end portion, so that the portion can serve as an abutment.

5. An apparatus as claimed in claim 3 wherein the lock cam member has a second projection to engage with the projection of the slide cam member.

6. An apparatus as claimed in claim 5 wherein the lock cam has a groove containing a hole having an effective size to receive a pin.

7. An apparatus as claimed in claim 1, wherein a hinge pin is further provided and the cam mechanism at the left side and right side uses the hinge pin as a pivot axis in the second engagement position when the door is opened from the right side and left side respectively.

8. An apparatus as claimed in claim 7, wherein the slide cam member is arranged in a position opposite to the lock cam member, and the door is supported by the hinge pin via the slide cam member.

9. The apparatus as claimed in claim 1, wherein a hinge pin is provided through and penetrating one of the cam mechanisms and engaging a groove in another one of the cam mechanisms, so that when the door is opened from the right or left side, the hinge pin provides a pivot axis for the door on a side opposite from the right or left side of the door.

10. An apparatus comprising:

cam mechanisms which are respectively provided on the right-hand and left-hand sides of a door and cause the door to be engaged with and disengaged from a main body, the cam mechanisms including means for assuming a first engagement positions, which is symmetrically arranged on the right-hand and left-hand sides of the door, and a second engagement position which is symmetrically arranged on the right-hand and left-hand sides of the door, and wherein the right-hand and left-hand cam mechanisms assume the first engagement position in a state in which the door is closed, and the door slides when the door is opened at one side of the right-hand side and the left-hand side of the door, so that the cam mechanism at the other side assumes the second engagement position and is pivotally locked in the second engagement position; and an assisting means for urging the door toward the second engagement position so as to assist the locked state in the second engagement position.

11. An apparatus as claimed in claim 10, wherein the assisting means is formed of a member integrated with the cam mechanism.

12. An apparatus as claimed in claim 10, wherein the cam mechanism is comprised of a lock cam member provided on the main body and a slide cam member provided on the door, and the assisting means is comprised of at least one slide cam integrally provided with the slide cam member and at least one cam which is integrally provided with the lock cam member and is put in sliding contact with the slide cam.

* * * * *